US006981758B2

(12) United States Patent
Cruz-Uribe et al.

(10) Patent No.: US 6,981,758 B2
(45) Date of Patent: Jan. 3, 2006

(54) PHOTONICALLY ACTIVATED FLUID DISPENSING SYSTEM AND METHODS

(75) Inventors: Tony Cruz-Uribe, Corvallis, OR (US); Morad Samii, La Jolla, CA (US); Scott W Hock, Poway, CA (US); Marshall Field, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 10/631,329

(22) Filed: Jul. 30, 2003

(65) Prior Publication Data

US 2005/0024448 A1 Feb. 3, 2005

(51) Int. Cl.
*B41J 2/16* (2006.01)

(52) U.S. Cl. ..... 347/51

(58) Field of Classification Search ..... 347/14, 347/19, 56, 58, 59, 68, 51
See application file for complete search history.

(56) References Cited

U.S. PATENT DOCUMENTS 4,794,463 A * 12/1988 Tamura et al. ..... 358/296
5,124,544 A 6/1992 Ohzu
5,276,459 A * 1/1994 Danzuka et al. ..... 346/33 A
5,796,415 A * 8/1998 Inoue et al. ..... 347/45
5,841,448 A 11/1998 Moriyama et al.
6,053,597 A * 4/2000 Hirota ..... 347/19

OTHER PUBLICATIONS

Hewlett-Packard Docket No.10011831-1, PTO Applicatino No. 10/164786: filed Jun. 07, 2002: Title: Fluid Ejection And Scanning System With Photosensor Activation Of Ejection Elements.
Hewlett-Packard Docket No. 100201722-1, PTO Applicatino No. 10/164540; filed Jun. 07, 2002: Title: Printhead And Scanning Assembly With Light-Activated Array Elements.
Hewlett-Packard Docket No. 200205842-1, PTO Applicatino No. 10/164808; filed Jun. 07, 2002: title: Fluid Ejection System With Photosensor Activation Of Ejection Element.
Hewlett-Packard Docket No. 200205843-1, PTO Applicatino No. 10/165226; filed Jun. 07, 2002; Title: Photosensor Activation Of An Ejection Element Of A Fluid Ejection Device.

* cited by examiner

*Primary Examiner*—Anh T. N. Vo
(74) *Attorney, Agent, or Firm*—Donald J. Coulman

(57) ABSTRACT

A fluid dispensing system, including a photon source disposed on a moveable carriage and a fluid ejector array having a plurality of fluid ejection elements disposed on a substrate. Each fluid ejection element includes a fluid ejector, and a photodetector electrically coupled to the fluid ejector. Moving said photon source over at least a portion of the fluid ejector array, selectively illuminates the photodetectors, thereby selectively activating the fluid ejectors coupled to the illuminated photodetectors.

20 Claims, 13 Drawing Sheets

PHOTONICALLY ACTIVATED FLUID DISPENSING SYSTEM AND METHODS

BACKGROUND

DESCRIPTION OF THE ART

The micro-manipulation of fluids has tremendous potential in a wide variety of industrially relevant technologies and has seen substantial interest and development over the past several years. For example, in fields such as electronic printing technology using inkjet printers, the ability to accurately, reliably and reproducibly deliver precise quantities of a fluid to a particular location on a receiving medium becomes ever more critical as image quality improves and hence dots per inch increases. In addition, as the number and complexity of fluids manipulated or ejected increases, the susceptibility of the microfluidic device to degradation by components in those fluids also may increase, leading to a reduction in reliability. Further, demand is increasing to reduce the weight and compactness of the fluid ejector head as well as to reduce the cost of the fluid ejector head by utilizing devices that are easier to both assemble and adapt to high volume manufacturing lines. Such demands place additional requirements on both the processes and the materials.

In current use are a wide variety of highly efficient inkjet printing systems capable of dispensing ink in a rapid and accurate manner. Commercial products such as computer printers, graphics plotters, facsimile machines, and multi-function devices have been implemented with inkjet technology. However, there is a demand by consumers for ever-increasing improvements in speed and image quality. In addition, consumers increasingly insist on longer lasting fluid ejection cartridges. Inkjet cartridges typically include a fluid reservoir that is fluidically coupled to a fluid ejector head. One way to increase the speed of printing is to increase number of nozzles or fluid ejection elements contained on the fluid ejector head thus, increasing the size of the fluid ejector head, thereby ejecting fluid over a larger swath of the receiving medium. Each nozzle in a fluid ejector head generally includes a fluid ejection element, and a fluid containing chamber surrounding or adjacent to that fluid ejection element. During operation, the chamber receives fluid from a fluid supply through an inlet channel. The activation of the fluid ejection element ejects the fluid as a droplet through the nozzle and onto the receiving medium. As the number of fluid ejection elements increases, the amount of circuitry necessary to generate more timing and control signals, at a given time, substantially increases. Generally, to keep the number of electrical connections to a manageable number, many of the fluid ejection elements are formed on silicon substrates. The utilization of silicon substrates enables the forming of the electronic circuitry and memory cells, necessary to generate the control, timing, and drive signals to activate the fluid ejection elements, on the same substrate on which the fluid ejection elements are formed. Although this provides for a decrease in the number of electrical interconnects, it also greatly increases the cost of each fluid ejection cartridge as the size increases since fewer die can be formed on each wafer. In addition, as the complexity of these devices increases, the yields decrease which increases the cost.

Another way to increase the speed of printing is to move the print or fluid ejection cartridge faster across the print medium. However, if the fluid ejection cartridge includes both the fluid reservoir and the energy converting elements utilized to eject the ink then longer lasting print cartridges typically would require larger ink reservoirs, with the corresponding increase in mass associated with the additional ink. This increase in mass requires more costly and complex mechanisms to move at even higher speeds to produce the increased printing speed. For color printers, typically, requiring a black ink cartridge and 3 color cartridges this increase in mass is further exacerbated by requiring four ink reservoirs.

The ability to develop higher performance fluid dispensing systems, that are cheaper smaller and more reliable, will enable the continued growth and advancements in inkjet printing and other micro-fluidic devices. In addition, the ability to optimize fluid ejection systems will open up a wide variety of applications that are currently either impractical or not cost effective.

DESCRIPTION OF THE PREFERRED EMBODIMENTS

Figure 1A:
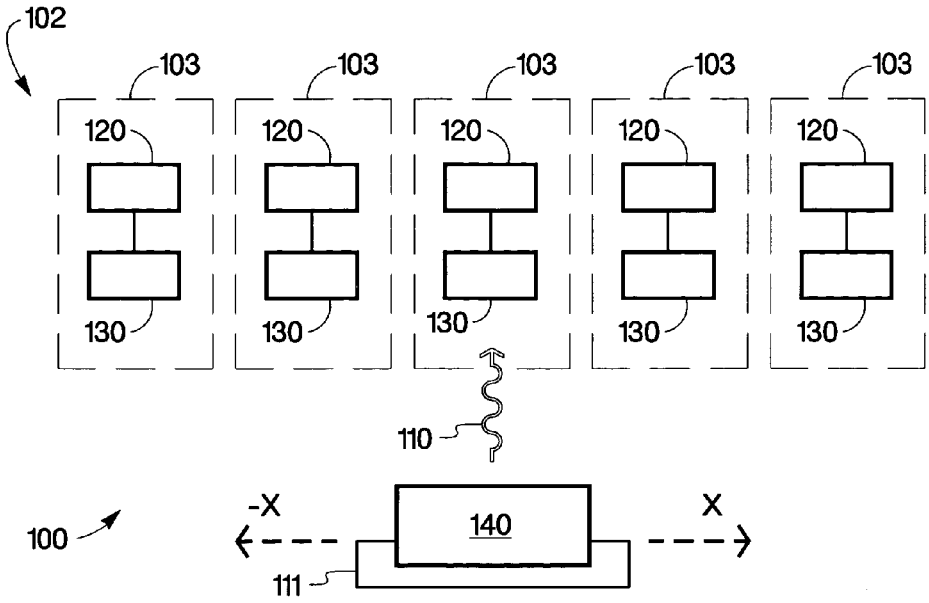
FIG. 1*a* is a schematic view of a fluid dispensing system according to an embodiment of the present invention.

An embodiment of fluid dispensing system 100 of the present invention is shown in FIG. 1*a,* in a simplified schematic diagram. In this embodiment, fluid ejector array 102 includes a plurality of fluid ejection array elements 103, with each fluid ejection element including one fluid ejector 120 and one photodetector 130. Each photodetector 130 is electrically coupled to a corresponding fluid ejector 120. Fluid dispensing system 100 also includes photon source 140 disposed on or within carriage 111. Carriage 111 is translationally reciprocatable over at least a portion of fluid ejector array 102 providing photonic coupling of photon source 140 with photodetectors 130. In one embodiment, carriage 111 may be scanned over or linearly translated across the entire length of the fluid ejector array, for example, when photon source 140 includes a single photon emitter. In alternate embodiments other scanning distances as well as scanning patterns also may be utilized. In addition, for those embodiments utilizing multiple rows of fluid ejectors carriage 111 may be scanned or translated over the fluid ejector utilizing various two dimensional patterns, such as sinusoidally, triangular, or square wave patterns.

A drop-firing controller (not shown) provides signals to photon source 140 to selectively activate photon source 140 when photonically aligned with a desired photodetector 130 of fluid ejector array 102. Photons 110 emitted from photon source 140 are absorbed by photodetector 130; and generate an activation signal activating fluid ejector 120 to eject fluid from fluid dispensing system 100. Thus, photons emitted from photon source 140 selectively interact with the plurality of photodetectors generating activation signals that selectively activate the plurality of fluid ejectors ejecting fluid away from the fluid ejector array. The light output of photon source 140 also may be modulated so that information is contained in the photon beam impinging on photodetector 130. This information is utilized, either directly or indirectly through further signal processing, to actuate fluid ejector 120.

Photon source 140, may be any modulatable photon source of sufficient intensity to generate a signal in a photodetector. In this embodiment, photon source 140 includes any photon source emitting photons in some portion of the electromagnetic spectrum from the ultraviolet region to the infrared region including visible radiation. For example, photon source 140 may be a light emitting diode (LED), a laser (in particular a solid state laser), a lamp, a luminescent source (such as an electroluminescent source utilizing either an ac or dc electric field), to name a few sources. In addition, the photon source may also utilize what is generally referred to as a photonic crystal providing, for example, increased efficiency.

Fluid ejector 120 may be any device capable of imparting sufficient energy to the fluid to cause ejection of fluid from a chamber. For example, compressed air actuators, such as utilized in an airbrush, or electromechanical actuators or thermal mechanical actuators may be utilized to eject the fluid from the chamber. In alternative embodiments, fluid ejector 120 also may include an energy converting element such as a resistor or a piezoelectric transducer.

Photodetector 130 may be any device capable of interacting with photons sufficient to generate a signal distinguishable over the noise and leakage current of the device. For example, photoconductive devices such as a photodiode or phototransistor, or photovoltaic devices such as p-n silicon or selenium cells, or photoemissive devices may all be utilized. The particular photodetector utilized will depend on various parameters such as the wavelength region emitted by the particular photon source utilized, the amount of amplification of the detection signal, and the particular fluid ejection characteristics of the fluid ejector utilized, to name just a few. For example, in one embodiment photodetector 130 may be a photodiode, photon source 140 may be an LED and fluid ejector 120 may include an energy converting element such as a thermal resistor. When a pulse of photons is emitted from the LED, the electrical conductivity of the photodiode is increased to provide a drive current from a power supply to heat the thermal resistor. The energy impulse applied across the thermal resistor rapidly heats a component in the fluid above its boiling point causing vaporization of the fluid component resulting in an expanding bubble that ejects a fluid drop from a chamber (not shown). In alternate embodiments, other fluid energy converting elements such as piezoelectric, acoustic, mechanical, and electrostatic generators may also be utilized. For example, a piezoelectric element utilizes a voltage pulse to generate a compressive force on the fluid resulting in ejection of a drop of the fluid It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention to presently preferred embodiments.

Figure 1B:
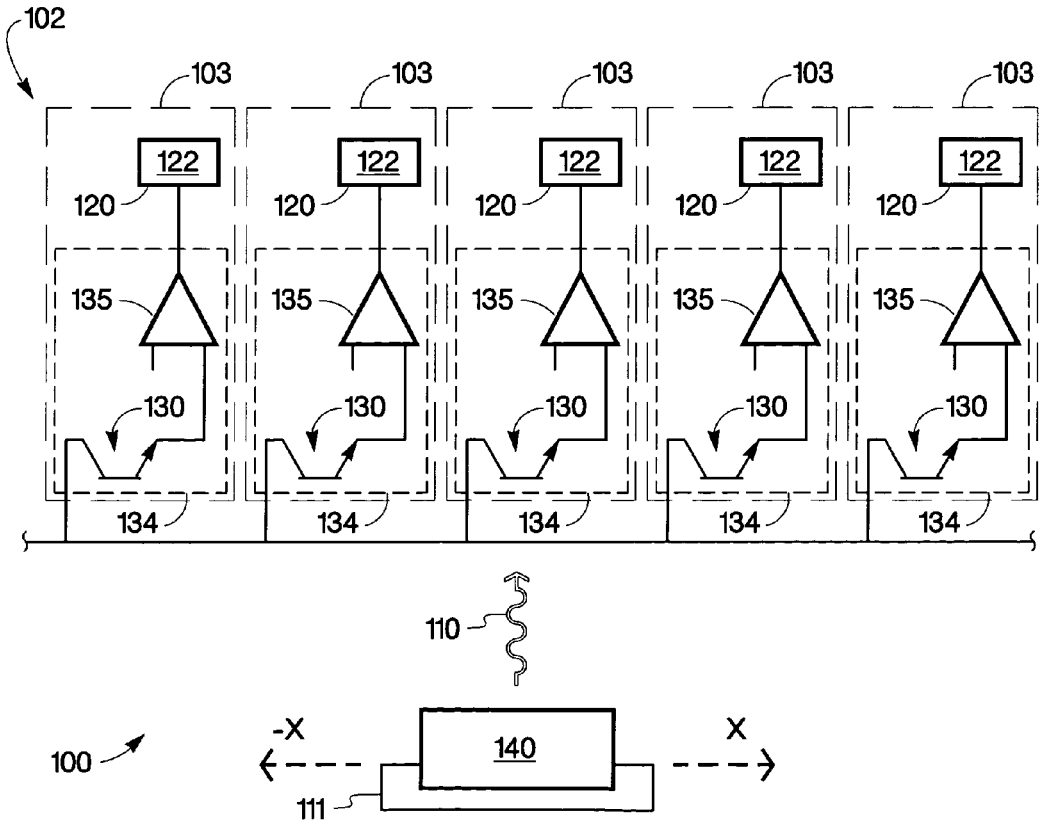
FIG. 1*b* is a schematic view of a fluid dispensing system according to an alternate embodiment of the present invention.

A simplified schematic diagram of an alternate embodiment of fluid dispensing system 100 is shown in FIG. 1*b*. In this embodiment, optical triggering circuit 134 includes photodetector 130 and amplifier 135. Photodetector 130, in this embodiment, is a phototransistor; however, in alternate embodiments, other photodetectors such as photodiodes or photo-Darlingtons may also be utilized. Photodetector 130 is coupled to amplifier 135 and to a power supply (not shown). Photons 110 emitted from photon source 140 generate a relatively low voltage output signal to amplifier 135. Amplifier 135 amplifies the received signal and delivers a corresponding energy pulse to fluid ejector 120 to eject fluid from fluid ejector array 102. In this embodiment, fluid ejector 120 is any device capable of imparting sufficient energy to the fluid to cause ejection of fluid from a chamber. Fluid ejector 120, in this embodiment, includes energy converting element 122, which is a thermal resistor. In alternate embodiments, other fluid energy converting elements such as piezoelectric, acoustic, and electrostatic generators may also be utilized. Photodetector 130 may be any device capable of interacting with photons sufficient to generate a signal distinguishable over the noise and leakage current of the device.

Figure 1C:
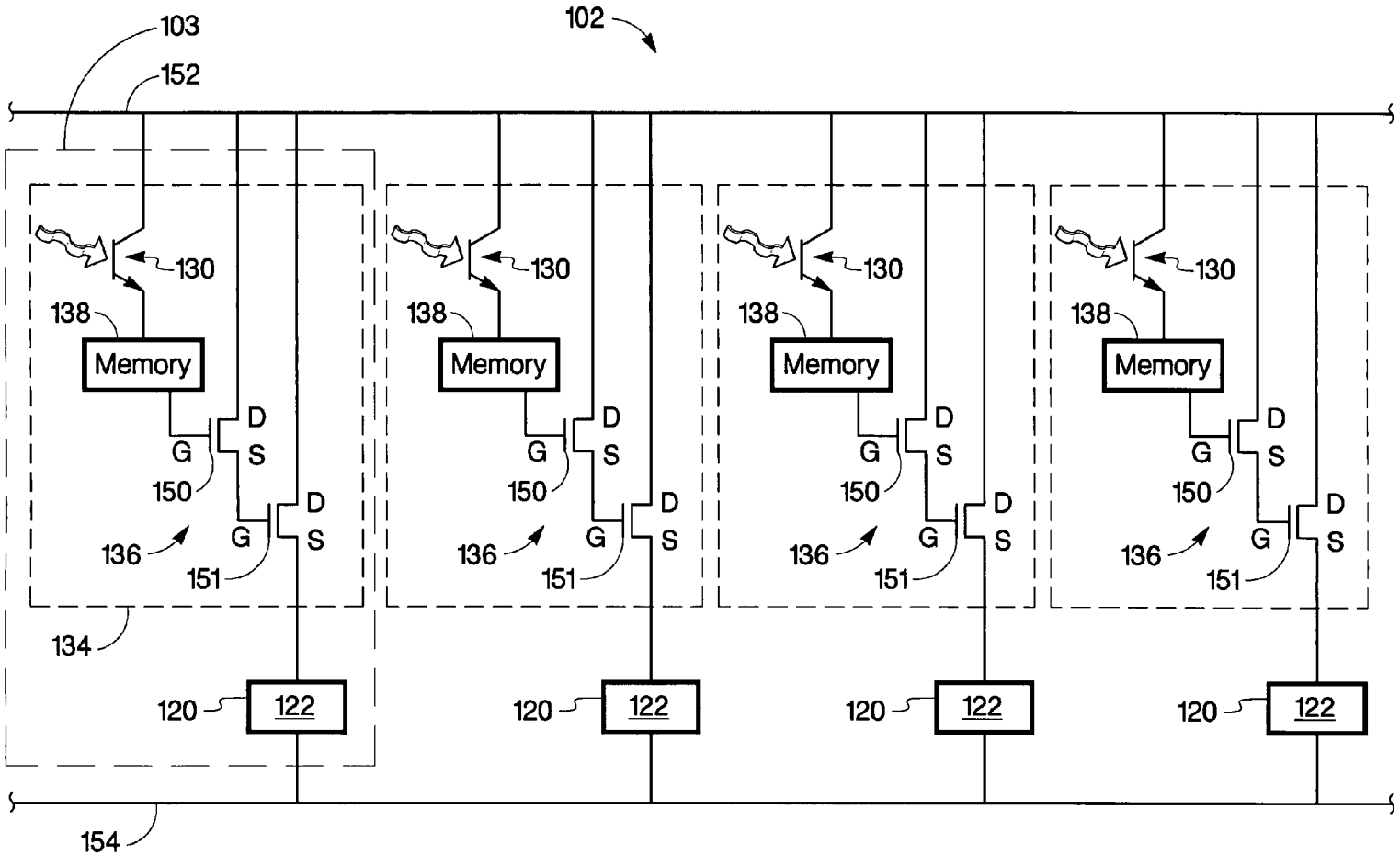
FIG. 1*c* is a schematic view of a portion of a fluid ejector array according to an embodiment of the present invention.

An alternate embodiment of the present invention where each optical triggering circuit 134 includes voltage level shifter 136, memory device 138 such as a latch, and photodetector 130 as shown in FIG. 1*c,* in a simplified schematic diagram. In one embodiment, memory device 138 is a toggle or T-type flip-flop that utilizes a second photon pulse to reset the latch. In still other embodiments other types of latches including latches having separate reset terminals may also be utilized. In addition, other memory devices such as a charge storage capacitor may also be utilized. Voltage level shifter 136 includes transistors 150 and 151. In this embodiment, fluid ejector array 102 includes a plurality of array elements 103 wherein each array element 103 includes, optical triggering circuit 134, and fluid ejector 120. In the embodiment shown, fluid ejector 120 includes fluid energy converting element 122 which is a thermal resistor; however, in alternate embodiments any of the fluid ejectors described above may also be utilized. In still other embodiments, various combinations of fluid ejectors may also be used. For example, some of the array elements may include thermal resistors utilized to eject the fluid and other array elements may include piezoelectric transducers to also eject the fluid, all in the same fluid ejector array.

In one embodiment, transistors 150 and 151 are metal-oxide-semiconductor field effect transistors (MOSFETs), as shown in FIG. 1*c*. However, in other embodiments, various types of solid state devices may be utilized, such as, junction field effect transistors (JFETs), bipolar junction transistors (BJTs), and silicon controlled rectifiers (SCRs), as well as combinations of these devices. For those embodiments utilizing a non-crystalline semiconductor substrate, such as a glass, a ceramic, or a polymer substrate, transistors 150 and 151 may be larger than that typically used on crystalline semiconductor substrates such as silicon. The larger size may be used because the electron mobility of amorphous or polycrystalline devices created on a dielectric substrate is, generally, lower than that of conventionally doped crystalline devices. In one embodiment, utilizing a glass substrate transistor 150 has a length of about 2 micrometers to about 8 micrometers, and a width of about 100 micrometers to about 200 micrometers; transistor 151 has a length of about 2 micrometers to about 6 micrometers, and a width of about 600 micrometers to about 10,000 micrometers. In alternate embodiments, other configurations and component dimensions may be utilized for optical triggering circuit 134.

Still referring to FIG. 1*c,* each photodetector 130 of array element 103 is coupled to voltage supply line 152. The output stage of each photodetector 130 is coupled to an input of memory device 138. An output of memory device 138 is coupled to the gate (G) of transistor 150. The drain (D) of each transistor 150 and 151 is coupled to voltage supply line 152, and the source (S) of each transistor 150 is coupled to the gate of transistor 151. The source of each transistor 151 is coupled to fluid ejector 120. In this embodiment, each thermal resistor 122 is coupled between the source of transistor 151 and the ground bus line 154. When a particular element of array element 103 is activated by light from the photon source, that particular photodetector 130 sets memory device 138, which in turn will turn on transistor 150. Transistor 150 in turn, turns on transistor 151, which activates fluid ejector 120 to eject fluid from fluid ejector array 102. In this embodiment, transistor 150 acts as a voltage controlled FET, and serves to control the current of transistor 151.

Figure 2A:
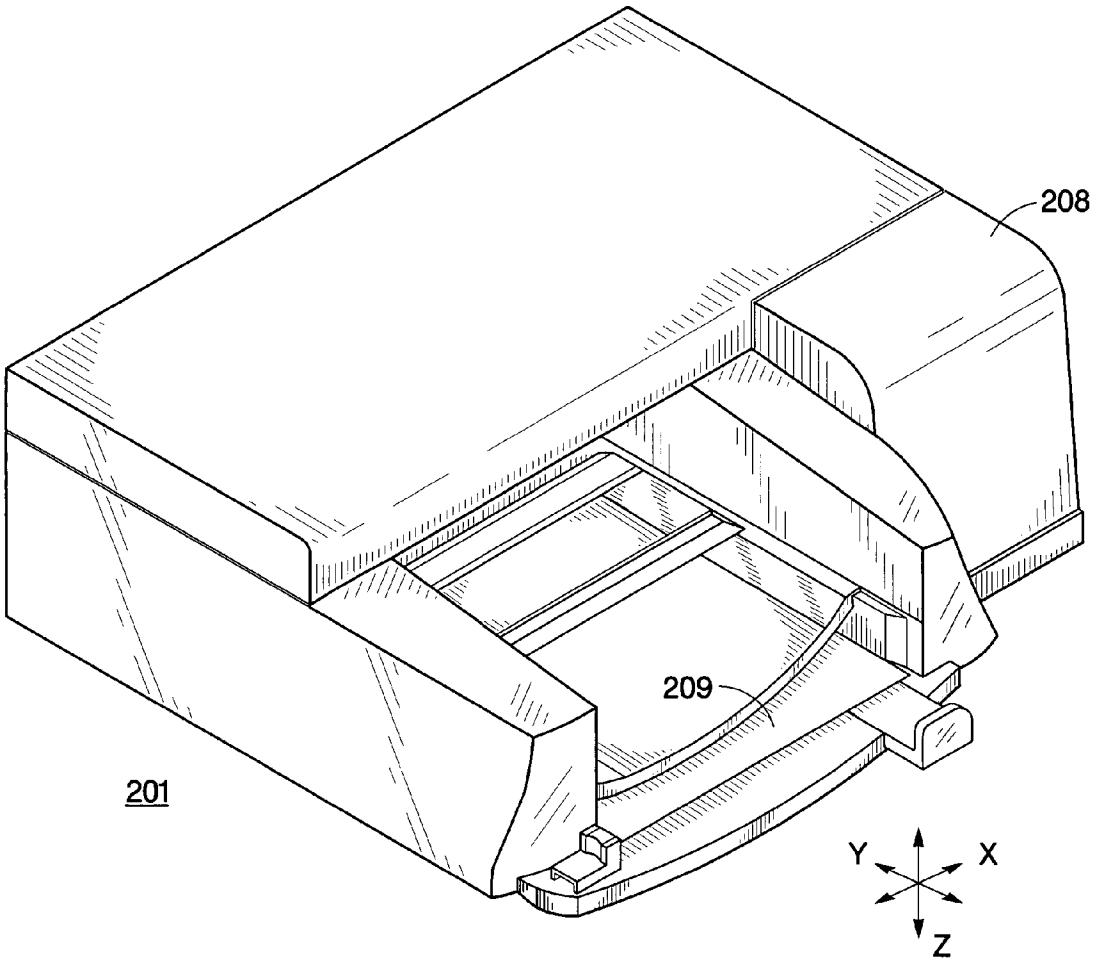
FIG. 2*a* is an isometric view of a fluid dispensing system according to an embodiment of the present invention.

An exemplary fluid dispensing system, printer 201, that may employ the present invention is shown in outline form in the isometric drawing of FIG. 2*a*. Other printing or hardcopy devices such as graphics plotters, facsimile machines, copiers and multi-function devices to name just a few may also employ the present invention. In addition, the present invention may also be utilized in other devices such as the preparation and manufacture of pharmaceutical dosage forms on ingestible sheets, in the dispensing of chemical or biological reagents, in the formation and creation of electronic devices and electrical circuits on various substrates, in the application of coatings, and in the deposition of adhesives and lubricants to name just a few examples. A printer housing 208 contains a printing platen to which an input fluid receiving medium 209, such as paper or an ingestible sheet, is transported by mechanisms that are known in the art.

Figure 2B:
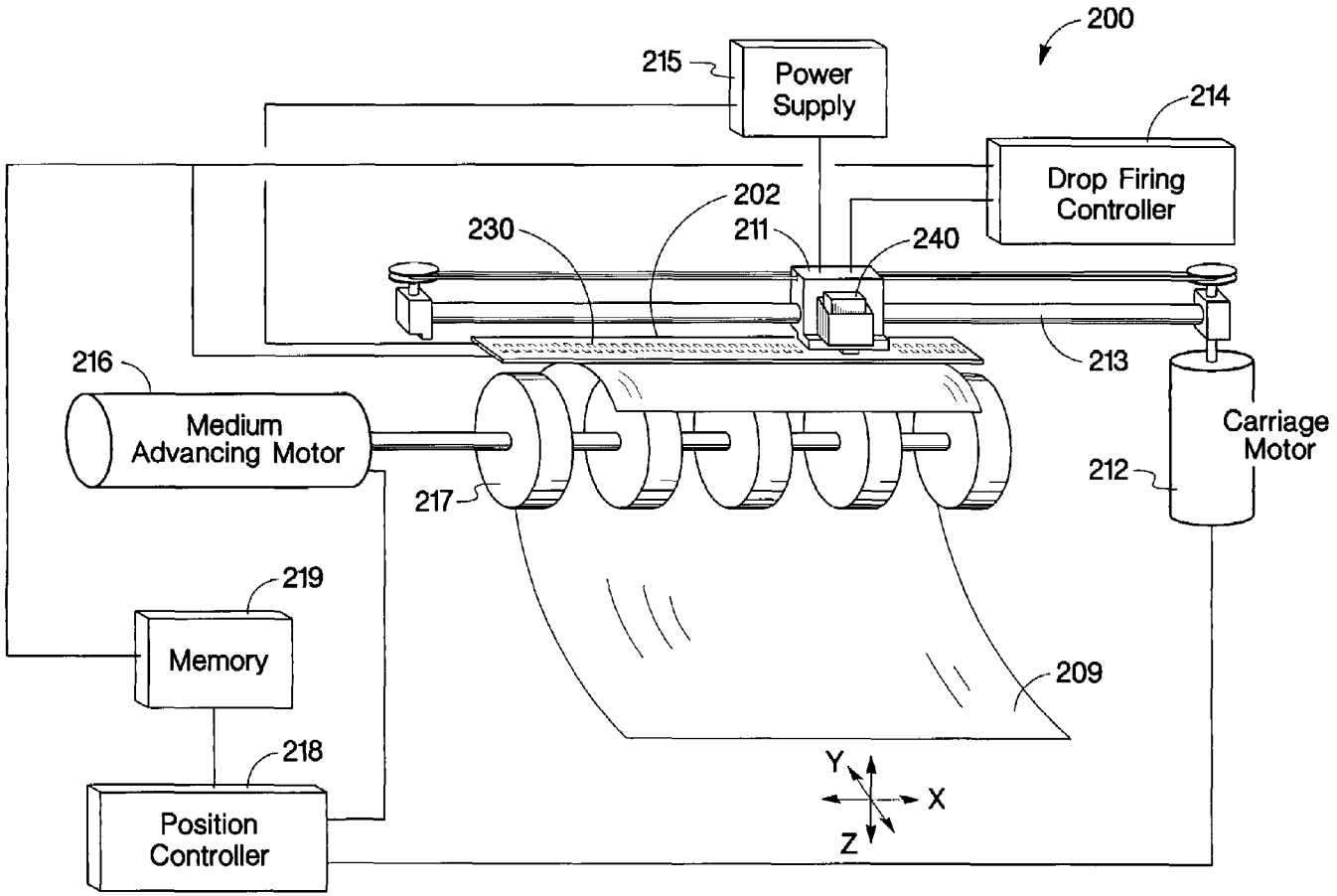
FIG. 2*b* is a schematic representation of some of the functional elements included in the fluid dispensing system shown in FIG. 2*a*.

Some of the functional elements included in fluid dispensing system 200, according to an embodiment of the present invention, are shown in a block diagram in FIG. 2*b*. In this embodiment, carriage 211 is typically supported by slide bar 213 or similar mechanism within fluid dispensing system 200 and physically propelled along slide bar 213 to allow carriage 211 to be translationally reciprocated or scanned back and forth across or over the back of or non fluid ejecting side of fluid ejector array 202. The scan axis, X, is indicated by an arrow in FIGS. 2*a* and 2*b*. Under control of drop firing controller 214 and position controller 218, carriage 211 scans across fluid ejector array 202, and fluid drops are selectively ejected from fluid ejectors (not shown) disposed on or within fluid ejector array 202 onto the fluid receiving medium 209 as illustrated in FIG. 2*b*. The power to activate the fluid ejectors, photon source, photodetectors and other circuitry is supplied by power supply 215. Drop firing controller 214 provides the timing and signals to selectively activate photon source 240 when photonically aligned with a desired photodetector 230 of fluid ejector array 202. Photons emitted from photon source 240 are absorbed by the selected photodetector 230 generating an activation signal that in turn activates a fluid ejector to eject fluid drops from fluid ejector array 202.

By selectively activating photon source 240 fluid drops are ejected from selective fluid ejectors to form predetermined fluid dispensed patterns, forming images, alphanumeric characters or combinations thereof using dot matrix manipulation. In alternate embodiments, the fluid dispensed patterns will be determined by the particular application in which fluid dispensing system 200 is utilized, such as creating a dosage form on an ingestible sheet, creating an adhesive pattern on an adherend, or selectively depositing a material on a substrate to create an electronic device. Generally, a user's computer (not shown) determines the dot matrix manipulation and instructions are transmitted to a microprocessor-based, electronic controller within the fluid dispensing system 200.

Other techniques employ a rasterization of the data in a host or user's computer such as a personal computer or PC (not shown) prior to the rasterized data being sent, along with the system control commands, to the system. This operation is under control of system driver software resident in the system's computer. The system interprets the commands and rasterized data to determine which fluid ejectors to fire. Still other system configurations or system architectures for the rasterization of data are possible. An arrow in FIGS. 2*a* and 2*b* indicates the fluid drop trajectory axis, Z, directed from the fluid ejector array 202 toward the fluid receiving medium 209 as illustrated in FIG. 2*b*. When a line (or in those embodiments utilizing multiple arrays—"a swath") of fluid ejection has been completed, fluid receiving medium 209 is moved an appropriate distance along the fluid receiving medium axis, Y, indicated by the arrow, in preparation for the next line or swath shown in FIG. 2*a*. This invention is also applicable to fluid dispensing systems employing alternative means of imparting relative motion between the fluid ejector array and the fluid receiving medium, such as those that have fixed fluid receiving medium and move the fluid ejector array in one or more directions.

As can be appreciated from the exemplary embodiment shown in FIG. 2*b,* fluid receiving medium 209 is advanced into a fluid ejection area beneath fluid ejector array 202 by a receiving medium or sheet positioning mechanism commonly referred to as a sheet positioner or sheet advancer including rollers 217, medium advancing motor 216, and traction devices (not shown). In this embodiment, photon source 240 is incrementally drawn across fluid ejector array by a carriage motor 212 in the ±X direction, perpendicular to the Y direction of entry of the receiving medium. Medium advancing motor 216 and carriage motor 212 are typically under the control of medium and photon source position controller 218. An example of such a positioning and control apparatus may be found and described in U.S. Pat. No. 5,070,410 "Apparatus and Method of Using a Combined Read/Write Head for Processing and Storing Read Signals and for Providing Firing Signals to Thermally Actuated Ink Ejection Elements". Thus, fluid receiving medium 209 is positioned in a location so that the fluid ejectors disposed on fluid ejector array 202 may eject drops of fluid to place dots onto fluid receiving medium 209 as desired for the particular data being written that is input to drop-firing controller 214 of fluid dispensing system 200. These dots of fluid are formed from the drops of fluid expelled from selected orifices in the fluid ejector array in a band parallel to the scan direction as photon source 240 is translated across fluid ejector array 202 by the carriage motor 212. When photon source 240 reaches the end of its travel at an end of a line or print swath on receiving medium 209, the receiving medium is conventionally incrementally advanced by the position controller 218 and medium advancing motor 216. Once photon source 240 has reached the end of its traverse in the X direction on the slide bar, it is either returned back along the support mechanism while continuing to eject fluid or returned without fluid ejection. Receiving medium 209 may be advanced by an incremental amount equivalent to the width of the fluid-ejecting portion of the fluid ejector array 202 or some fraction thereof related to the spacing between the nozzles. Control of receiving medium 209, positioning of photon source 240, and selection of the correct fluid ejectors for creation of the image, the character, or other fluid pattern written is determined by position controller 218 and drop-firing controller 214. The controllers may be implemented in a conventional electronic hardware configuration and provided operating instructions from conventional memory 219.

Figure 3A:
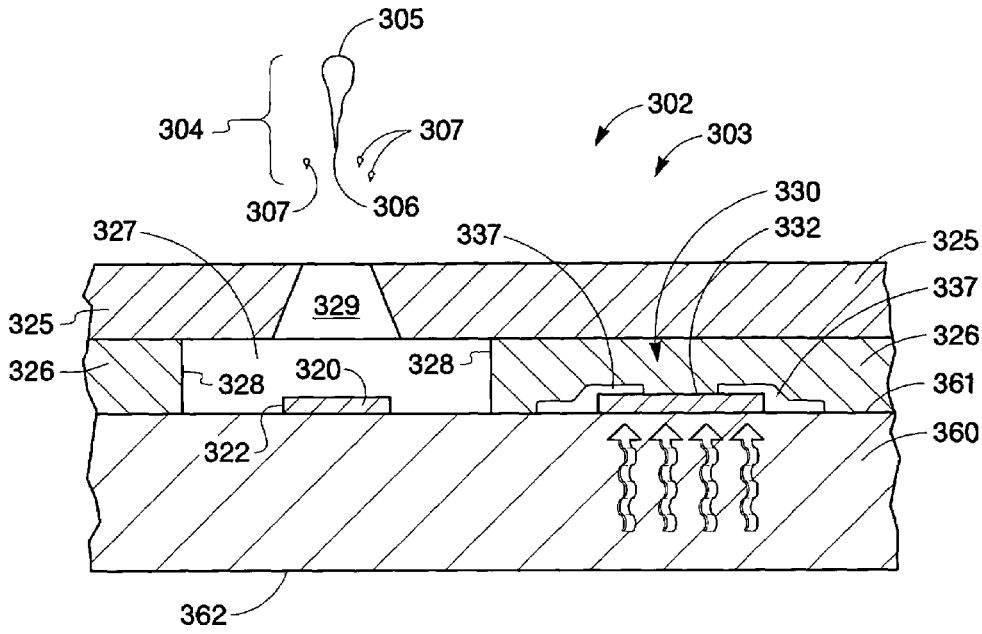
FIG. 3*a* is a cross-sectional view of a fluid ejection array element according to an embodiment of the present invention.

An exemplary embodiment of fluid ejection array element 303 of fluid ejector array 302 of the present invention, is shown, in a cross-sectional view, in FIG. 3*a*. In this embodiment, fluid ejector 320 and photodetector 330 are disposed on essentially optically transparent substrate 360. Photodetector 330 is disposed on front surface or fluid ejector substrate surface 361 of substrate 360. Fluid ejector 320 includes fluid energy converting element 322. Electrical interconnect 337 electrically couples photodetector 330 to fluid ejector 320 via an electrical trace (not shown) that is disposed on substrate 360 either in or out of the plane of the drawing. In this embodiment, substrate 360 is a glass substrate and may include any of the borosilicate, soda lime or quartz glasses (including crystalline and amorphous). However, in alternate embodiments, materials such as silicon oxide including silicon dioxide or silicon oxynitride, silica mixed with oxides of, for example, potassium, calcium, barium or lead, sapphire, or various polymers such as polycarbonates, polyethylene terephthalates, polystyrenes, polyimides, and polyacrylates including polymethylacrylate may also be utilized. In this embodiment, substrate 360 has sufficient transmittance in the wavelength region of photons emitted from the photon source to provide a signal to noise ratio of at least two to one. The photon source (not shown) photonically couples to photodetector 330 through substrate 360 via opposing major substrate surface 362. Semiconductor materials transmit photons with energies less than the band gap energy of the semiconductor material (i.e. all photons greater than or equal to the band gap energy are absorbed). Thus, in still other embodiments, any substrate sufficiently optically transparent in essentially the wavelength range emitted by the photon source providing a detectable signal to noise ratio also may be utilized. For example, substrate 360 may be a silicon substrate that transmits light in the infrared region from about 1.3 microns to about 6.7 microns. In such an embodiment, the fluid dispensing system would include a photon source emitting in this wavelength region such as solid state diodes or lasers whose active elements include GaAs, InP, $PbS_{(1-x)}Se_x$, $Pb_{(1-x)}Sn_xTe$, or $Pb_{(1-x)}Sn_xSe$.

Chamber layer 326 is selectively disposed over fluid ejector substrate surface 361 of substrate 360. In this embodiment, the fluid inlet channels (not shown) and the fluid distribution manifold (not shown) are formed in chamber layer 326 in and out of the plane of cross-sectional FIG. 3*a*. Side-walls 328 define fluid ejection chamber 327, around energy converting element 322, so that fluid, from the fluid distribution manifold (not shown) via the fluid inlet channels may accumulate in fluid ejection chamber 327 prior to activation of energy converting element 322 and expulsion of fluid through nozzle or orifice 329 when energy converting element 322 is activated. Nozzle or orifice layer 325 is disposed over chamber layer 326 and includes one or more bores or nozzles 329 through which fluid is ejected. In alternate embodiments, depending on the particular materials utilized for chamber layer 326 and nozzle layer 325, an adhesive layer (not shown) may also be utilized to adhere nozzle layer 325 to chamber layer 326. In addition, depending on the particular material utilized for chamber layer 326, an adhesive layer (not shown) may also be utilized to adhere chamber layer 326 to substrate 360. Chamber layer 326, may be a photoimagible film that utilizes photolithographic equipment to form chamber layer 326 on substrate 322 and then define and develop fluid ejection chamber 327. In alternative embodiments fluid ejection chamber 327 also may be formed by utilizing other methods such as etching directly into the glass or other substrates, pressure formed, embossed, laser ablated.

Nozzle layer 325 may be formed of metal, polymer, glass, or other suitable material such as ceramic. In one embodiment chamber layer 326 and nozzle layer 325 are formed as a single layer. Such an integrated chamber and nozzle layer structure is commonly referred to as a chamber orifice or chamber nozzle layer. In a second embodiment, nozzle layer 325 is a polyimide film. Examples of commercially available nozzle layer materials include a polyimide film available from E. I. DuPont de Nemours & Co. sold under the trade name "Kapton", a polyimide material available from Ube Industries, LTD (of Japan) sold under the trade name "Upilex." In an alternate embodiment, nozzle layer 325 may be formed from a metal such as a nickel base enclosed by a thin gold, palladium, tantalum, or rhodium layer. In other alternative embodiments, nozzle layer 325 may be formed from polymers such as polyesters, polyethylene naphthalates (PEN), epoxies, or polycarbonates.

Fluid ejector 320 includes energy converting element 322, in this embodiment, shown in FIG. 3*a,* and may be any of the fluid energy converting elements described above such as, for example, a thermal resistor. In such an embodiment, an electrical energy impulse applied across the thermal resistor rapidly heats at least one component in the fluid above its boiling point causing vaporization of the fluid component resulting in an expanding bubble that ejects fluid drop 304 as shown in FIG. 3*a.* Fluid drop 304 typically includes droplet head 305, drop-tail 306, and satellite-drops 307, which may be characterized as essentially a fluid drop. In such an embodiment, each activation of energy converting element 322 results in the ejection of a precise quantity of fluid in the form of essentially a fluid drop; thus, the number of times the fluid energy converting element is activated controls the number of drops 304 ejected from nozzle 329 (i.e. n activations results in essentially n fluid drops). Thus, fluid ejection array element 303 may generate discrete droplets of a fluid, including, for example a solid material dissolved in one or more solvents or suspended or dispersed in the fluid, onto a discrete predetermined location on the surface of a receiving medium. Another example is a solid material that undergoes a phase change first, and is subsequently ejected from a drop generator.

The drop volume of fluid drop 304 may be optimized by adjusting various parameters such as nozzle bore diameter, nozzle layer thickness, chamber dimensions, chamber layer thickness, energy converting element dimensions, and the fluid surface tension to name a few. Thus, the drop volume can be optimized for the particular fluid being ejected as well as the particular application in which fluid ejector array 302 will be utilized. Fluid ejection array element 303 described in this embodiment can reproducibly and reliably eject drops in the range of from about 5 femto-liters to about 750 pico-liters depending on the parameters and structures of the fluid ejector array as described above. In this embodiment, the term fluid may include any fluid material such as inks, adhesives, lubricants, chemical or biological reagents, as well as fluids containing dissolved or dispersed solids in one or more solvents.

Photodetector 330 includes electrical interconnects 337 and photosensing layer 332 formed on fluid ejector substrate surface 361 of substrate 360. While photodetector 330 is represented as only a single layer in FIG. 3*a* to simplify the drawing, photodetector 330 may be realized as a stack of thin film layers. For example, photodetector 330 may be a photodiode formed by creating a polycrystalline p-type semiconductor layer with doped n-type wells formed in the polycrystalline p-type semiconductor layer. Electrical interconnects 337 connect with both p-type semiconductor layer and the n-type doped well. Another example involves forming a photodiode by creating a polycrystalline n-type semiconductor layer with doped p-type wells formed in the polycrystalline n-type semiconductor layer. Such detectors may be formed from a wide range of semiconductor materials, including for example silicon or germanium. In an alternate embodiment, an amorphous or an epitaxial semiconductor layer or layers may also be utilized. By utilizing various combinations of semiconducting layers and doped regions or wells, various photodiodes such as p-i-n photodiodes or photodiodes optimized to operate in the avalanche region as well as phototransistors are just a few examples of structures that may be utilized as photodetector 330. The particular photodetector utilized will depend on various parameters such as the wavelength and intensity of the photon source utilized, amount of amplification of the detector signal, the firing speed of the fluid ejector, as well as the particular environment in which fluid ejector array 302 will be utilized.

Figure 3B:
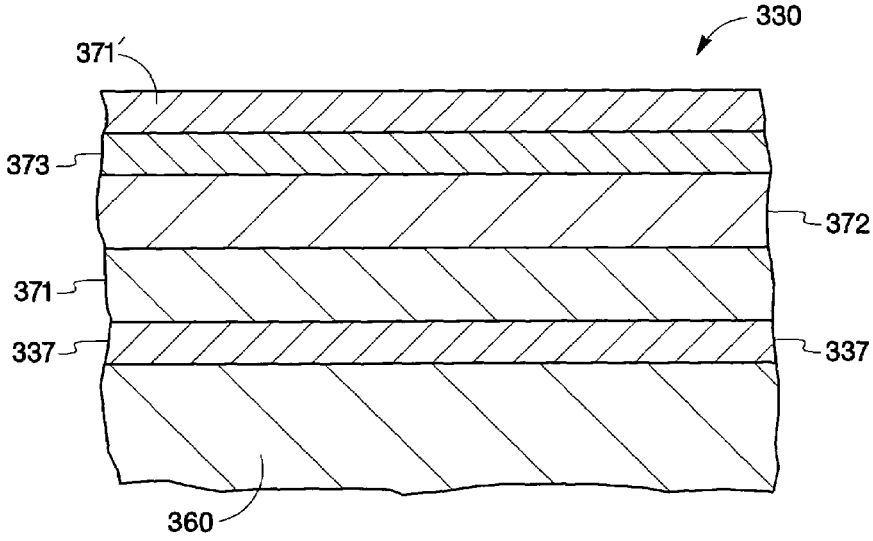
FIG. 3*b* is a cross-sectional view of a photodetector according to an embodiment of the present invention.

A planar structure that may be utilized to form photodetector 330 is shown in a cross-sectional view in FIG. 3*b.* In this embodiment, electrical interconnection 337 is an electrically conductive and essentially optically transparent indium tin oxide layer created or formed on substrate 360. Both the electrical conductivity as well as the optical properties of the indium tin oxide layer may be tuned to optimize the layer for the particular light source and photodetector being utilized. In alternate embodiments, typical metallization schemes such as aluminum or tungsten may also be utilized to provide electrical interconnection 337. In such embodiments, generally, a transparent material such as silicon dioxide will be formed in a desired region or area of photodetector 330 providing an optical path for photons emitted from the photon source to interact with photodetector 330. A heavily doped $p^+$-type polysilicon layer 371 is formed over the indium tin oxide layer followed by creation or formation of n-type doped polysilicon layer 372. Heavily doped $n^+$-type polysilicon layer 373 is formed over doped polysilicon layer 372. Aluminum, tungsten or other appropriate metal is deposited or formed on doped polysilicon layer 372 forming electrical interconnect 337'. In an alternative embodiment, the dopant utilized in polysilicon layers 371, 373, and 373 may be opposite of that described above (e.g. $n^+$-type polysilicon layer 371, p-type polysilicon layer 372, and $p^+$-type polysilicon layer 373).

An alternate embodiment of fluid ejection array element 403 of fluid ejector array 402 of the present invention is shown. In this embodiment, fluid ejector 420 and photodetector 430 are disposed on opposite sides of substrate 460. Substrate 460 has two opposing major surfaces substantially parallel to each other, first major surface 461 and second major surface 462. Fluid ejector 420 including fluid energy converting element 422 is disposed over first major surface 461 of substrate 460. Photodetector 430 is disposed over second major surface 462 with electrical through connect 470 electrically coupling photodetector 430 with fluid ejector 420 via an electrical trace (not shown) that is disposed on substrate 460 either in or out of the plane of the drawing. In this embodiment, substrate 460 is a mono-crystalline silicon substrate having a thickness of about 300–800 micrometers. However, in alternate embodiments, various glasses; ceramics such as aluminum oxide, boron nitride, silicon carbide, and sapphire; semiconductors such as gallium arsenide, indium phosphide, and germanium; and various polymers such as polyimides, and polycarbonates are just a few examples of the materials that may be utilized. Accordingly, the present invention is not intended to be limited to those devices fabricated in silicon semiconductor materials, but will include those devices fabricated in one or more of the available semiconductor materials and technologies known in the art, such as thin-film-transistor (TFT) technology using polysilicon on glass substrates. Further, substrate 460 is not restricted to typical wafer sizes, and may include processing a polymer sheet or film or glass sheet or for example a single crystal sheet or a substrate handled in a different form and size than that of conventional wafers or substrates. The actual substrate material utilized will depend on various system components such as the particular fluid ejector utilized, the particular fluid being ejected, the size and number of fluid ejectors utilized in the particular fluid ejector array, and the environment to which the fluid dispensing system will be subjected.

In this embodiment, fluid ejector 420 includes energy converting element 422, which is a thermal resistor. In alternate embodiments, other fluid energy converting elements such as piezoelectric, acoustic, and electrostatic generators may also be utilized. In still other embodiments, fluid ejector 420 may be any device capable of imparting sufficient energy to the fluid to cause ejection of fluid from a chamber, such as compressed air actuators, electromechanical actuators or thermal mechanical actuators. Chamber layer 426 is selectively disposed over first major surface 461 of substrate 460. Sidewalls 428 define or form fluid ejection chamber 427, around energy converting element 422, so that fluid, from fluid distribution channel 466 via fluid inlet channels 465, may accumulate in fluid ejection chamber 427. Activation of energy converting element 422 expels fluid from chamber 427. In alternate embodiments, depending on the particular material utilized for chamber layer 426, an adhesive layer (not shown) may also be utilized to adhere chamber layer 426 to substrate 460. Chamber layer 426, typically, is a photoimagible film that utilizes photolithography equipment to form chamber layer 426 on substrate 422 and then define and develop fluid ejection chamber 427.

Photodetector 430 includes electrical interconnects 437 and photosensing layer 432 formed on second major surface 462. Planarizing layer 439 is formed over photosensing layer 432 and electrical interconnects to provide electrical isolation and environmental protection of photosensing layer 432. In addition, planarizing layer 439 is sufficiently optically transparent in the wavelength region over which the photon source emits to provide a signal to noise ratio of at least two to one.

Figure 4:
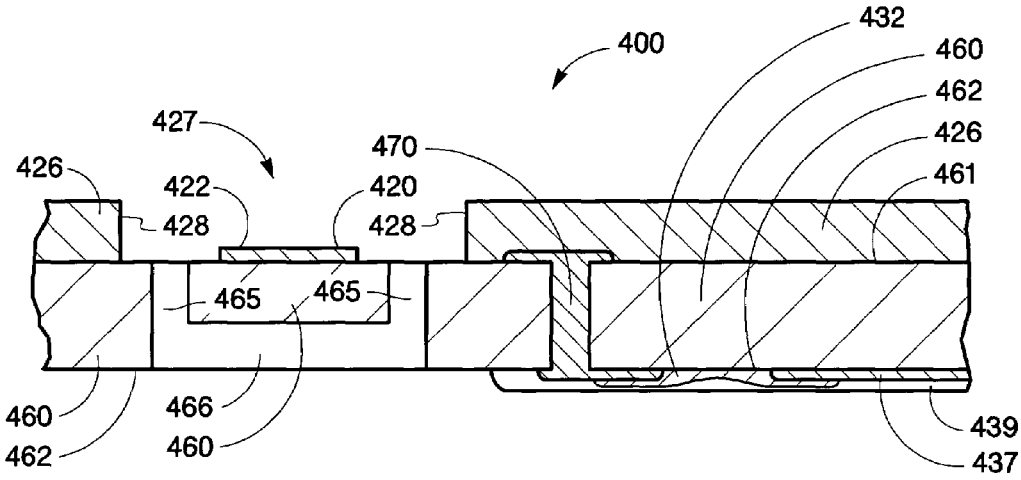
FIG. 4 is a cross-sectional view of a fluid ejection array element according to an alternate embodiment of the present invention.

Photodetector 430 is represented as only a single layer in FIG. 4 to simplify the drawing. Those skilled in the art will appreciate that photodetector 430 may be realized as a stack of thin film layers. For example, photodetector 430 may be a photodiode formed by creating doped wells in substrate 460 of opposite polarity to the dopant of substrate 460 (e.g. p-type wafer with n-type wells or n-type wafer with p-type wells). Electrical interconnects then connect with both the substrate and the doped well. Another example, is the deposition of polysilicon or epitaxial silicon on a buried oxide with corresponding doped well regions formed in the deposited layer to generate a photodiode. By utilizing various combinations of doped wells and layers, various photodiodes such as p-i-n photodiodes or photodiodes optimized to operate in the avalanche region, as well as phototransistors are just a few examples of structures that may be utilized as photodetector 430. The particular photodetector utilized will depend on various parameters such as the wavelength and intensity of the photon source utilized, the amount of amplification of the detector signal, firing speed of the fluid ejector, as well as the particular environment in which fluid ejector array 402 will be utilized.

Figure 5A:
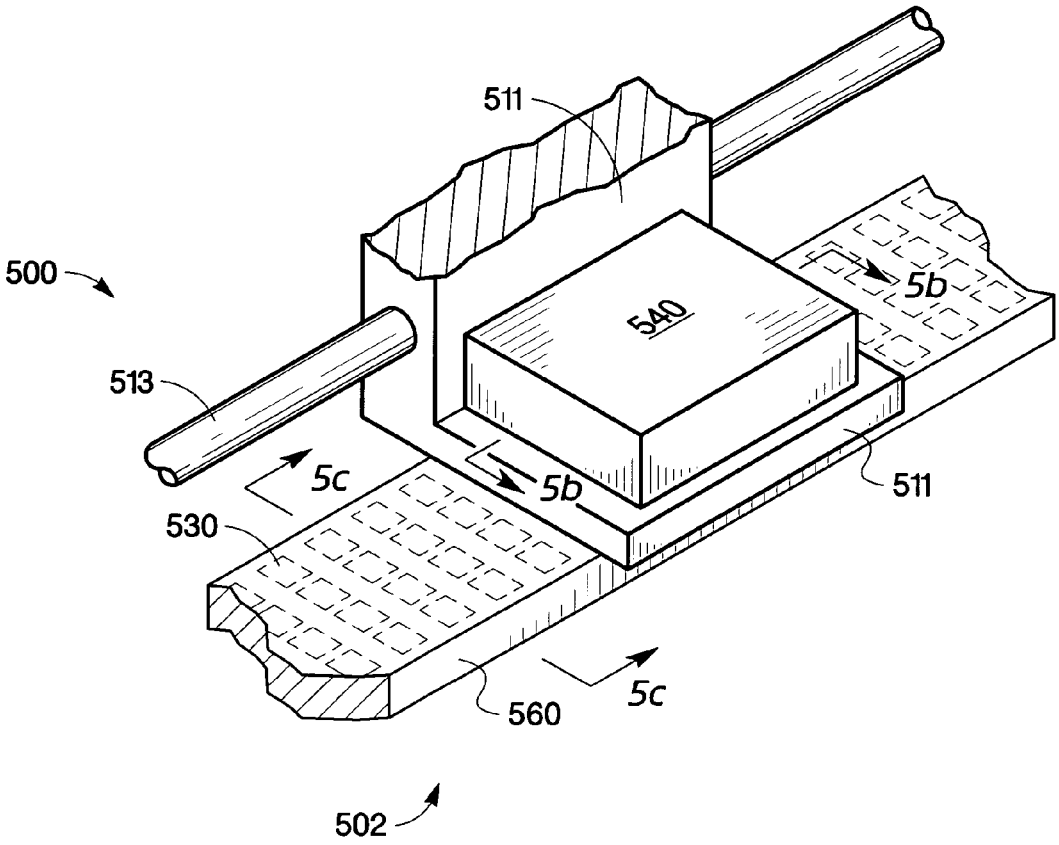
FIG. 5*a* is an isometric view of a fluid dispensing system according to an alternate embodiment of the present invention.

An alternate embodiment of fluid dispensing system 500, of the present invention, includes fluid ejector array 502 having multiple rows of fluid ejectors and photodetectors, and photon source 540 having multiple rows and columns of photon sources is illustrated in FIG. 5*a,* in an isometric view. In this embodiment, fluid ejector array 502 includes 4 rows of fluid ejectors with each fluid ejector electrically coupled to a photodetector. Photon source 540, in this embodiment, includes photon source array 547 (see FIG. 5*b*), a 3×4 array of photon emitters and is disposed on carriage 511 that is slidably coupled to slide bar 513. Carriage 511 may operate in any of the modes described above in FIG. 2*b*.

Figure 5B:
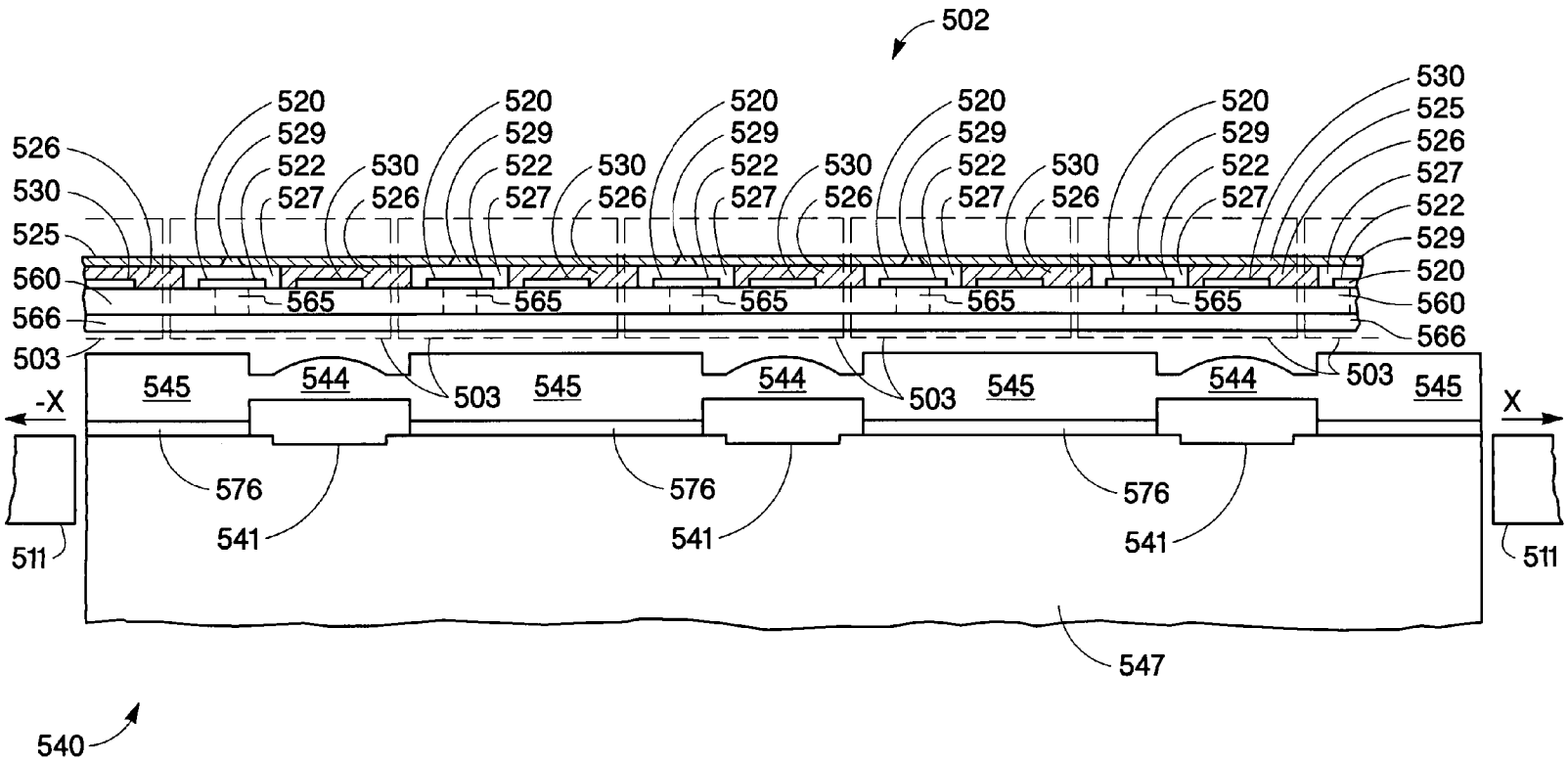
FIG. 5*b* is a cross-sectional view along 5*b*—5*b* showing a portion of the fluid ejector array and photon source shown in FIG. 5*a;*
Figure 5C:
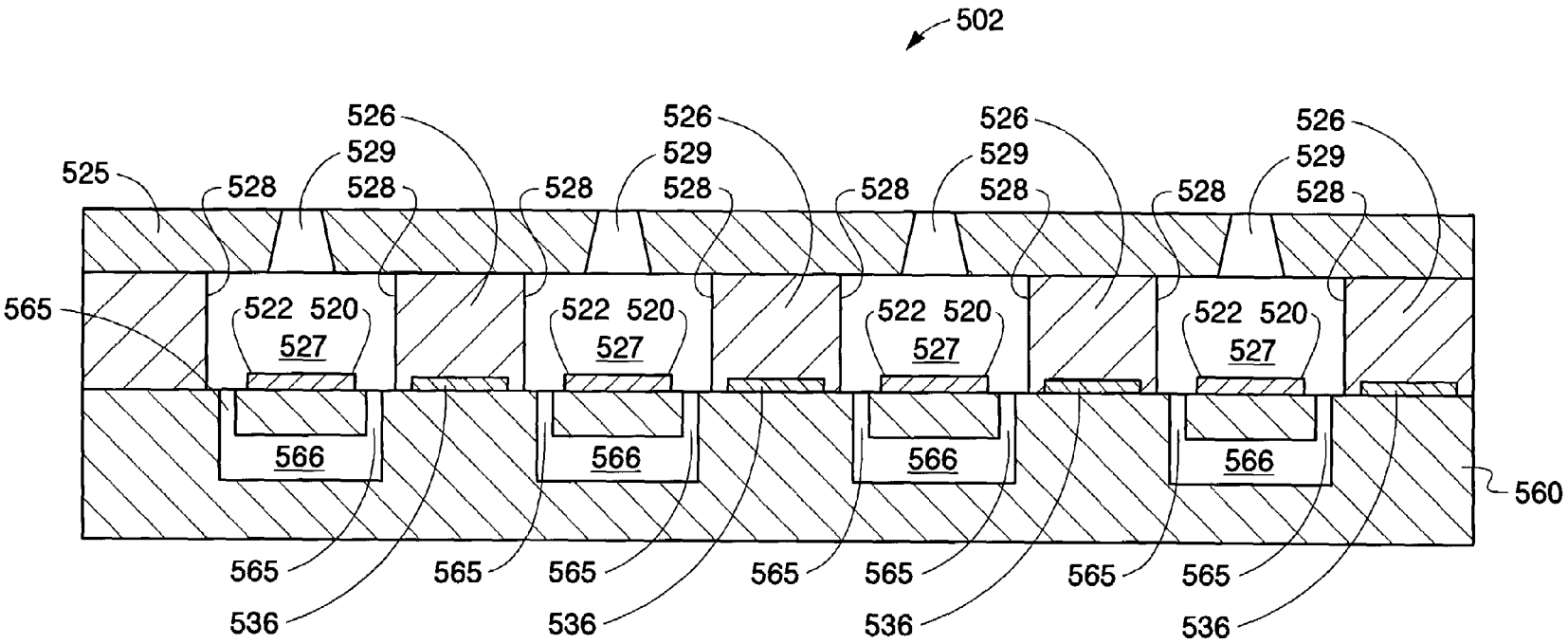
FIG. 5*c* is a cross-sectional view along 5*c*—5*c* showing the fluid ejector array shown in FIG. 5*a;*

Fluid ejector array 502 includes a plurality of array elements 503 as shown in FIGS. 5*b* and 5*c,* in simplified cross-sectional views. FIG. 5*b* is from the perspective of section line 5*b* intersecting one row of the 4 rows included in fluid ejector array 502 in this embodiment. FIG. 5*c* is from the perspective of section line 5*c* intersecting one column formed by the 4 rows of fluid ejectors. Fluid ejection array elements 503, as illustrated in FIG. 5*b,* include a plurality of fluid ejectors 520 and photodetectors 530 disposed on fluid ejector array substrate 560. Each array element 503 includes photodetector 530 which in turn is electrically coupled to fluid ejector 520. In this embodiment, fluid ejector 520 includes energy converting element 522, which may be any of the fluid energy converting elements described above such, as for example, a thermal resistor. In addition, in alternate embodiments, fluid ejector 520 may be any of the fluid ejectors described above.

Substrate 560, in this embodiment is substantially optically transparent with photodetector 530 disposed on the fluid ejector surface of substrate 560. However, in alternate embodiments photodetector 530 may be disposed on the backside or the non fluid ejector surface of substrate 560, wherein non-optically transparent substrates may also be utilized. An example of such a structure is shown in FIG. 4. Chamber layer 526 is selectively disposed over substrate 560 forming fluid ejection chamber 527 defined by side walls 528 as shown in a cross-sectional view taken of fluid ejector array 502 from the perspective of section line 5*c*. In addition, nozzle layer 525, in which noszzles 529 are formed, is disposed over chamber layer 526 as shown in FIGS. 5*b* and 5*c*. In alternate embodiments, nozzle layer may be omitted as shown in the embodiment described in FIG. 4. Fluid from a reservoir (not shown) flows through fluid delivery system (not shown) into fluid distribution channel 566 formed in substrate 560 and flows through fluid inlet channels 565 entering fluid ejection chamber 527.

As described above as carriage 511 is scanned across or over fluid ejector array 502 the various control circuitry described above selectively activates a photon emitter in photon source 540. The activation of the photon emitter in turn generates an actuation signal in the photodetector photonically coupled to the photon emitter at that particular time resulting in actuation of the fluid ejector 520 which in turn ejects fluid from nozzle 529 of that particular array element. For those embodiments utilizing a voltage level shifter or control circuitry, such as that shown in FIGS. 1*b* and 1*c,* voltage level shifter 536 is shown in FIG. 5*c* as a single layer where both its depiction as only a single layer and its location are only meant to simplify the drawing and to represent such circuitry which may be distributed on substrate 560. Depending on the particular application in which fluid ejector array 502 will be utilized voltage level shifter 536 will include various transistors, logic circuits and other passive devices electrically coupled to photodetector 530 and fluid ejector 520.

Photon source array 547, as noted above, includes a 3×4 array of photon emitters 541. In this embodiment, photon emitters 541 may be any photon source generating sufficient intensity to generate a signal in photodetector 530. For example, photon emitters 541 may be a light emitting diode (LED), a solid state laser, a lamp, or an electroluminescent source. In addition, each photon emitter also has lens 544 and lens mount 545, mounted essentially over each photon emitter 541. The lens and lens mount assembly, in this embodiment, is attached or mounted to photon emitter array 547 utilizing precut epoxy adhesive strip 576. In alternate embodiments, the assembly may be attached to the photon emitter array utilizing any of the known attachment methods such as fasteners, mechanical clamping arrangements, alignment structures, dispensed adhesives, and combinations of these as just a few examples.

Lens 544 may be any glass or plastic lens providing the desired focusing properties for the particular photon source and photodetector utilized. In alternate embodiments, other focusing elements may also be utilized, such as a rod lens with a graded refractive index profile providing a refractive index which decreases in a predetermined manner (e.g. quadratically) with the distance from the lens axis. Nippon Sheet Glass Co. sells an example of such a rod lens under the tradename of SELFOC including SELFOC microlens or SELFOC fiber array.

Each lens 544 may be separately mounted to photon source array 547 utilizing separate lens mounts 545 or as illustrated in FIG. 5*b* the lenses may be combined to form photon focusing array 546. In this embodiment, photon focusing array 546 is a micro-molded lenslet including a micro-molded lens 544 formed in the surface of photon focusing array 546. Micro-molded array mounts 545' also may be formed in the surface of photon focusing array 546 providing a simple method of mounting photon focusing array to photon source array 547. In alternate embodiments, micro-molded lenses formed on both sides of photon focusing array 546 also may be utilized as well as multiple lens arrangements.

As noted above photon source 540 in this embodiment includes a 3×4 array of photon emitters and fluid ejector array 502 includes 4 rows of fluid ejectors. For example, in one embodiment, printing at 300 dots per inch both black and color ink on an 8.5 inch by 11 inch paper sheet, one may utilize a fluid ejector array having 4 rows of fluid ejectors one row for black and 3 rows, one each, for cyan, magenta, and yellow inks. If we assume that we will print only over 8 inches of the 8.5 inch width we find that each row will contain 2400 fluid ejectors providing an array of 2400×4 fluid ejectors. In alternate embodiments, fluid ejector array 502 may include an m×n array of fluid ejectors 520 electrically coupled to an m×n array of photodetector elements 530, and photon source 540 includes a j×k array of photon emitters 541, where j is less than or equal to m, and k is less than or equal to n. For those embodiments where k is less than n either carriage 511 also includes a motion mechanism to step the photon source in the ±Y direction or fluid ejector array 502 includes such a motion mechanism. In still other embodiments j is less than m and m is an integral multiple of j, and k is less than n and n is an integral multiple of k.

Figure 6:
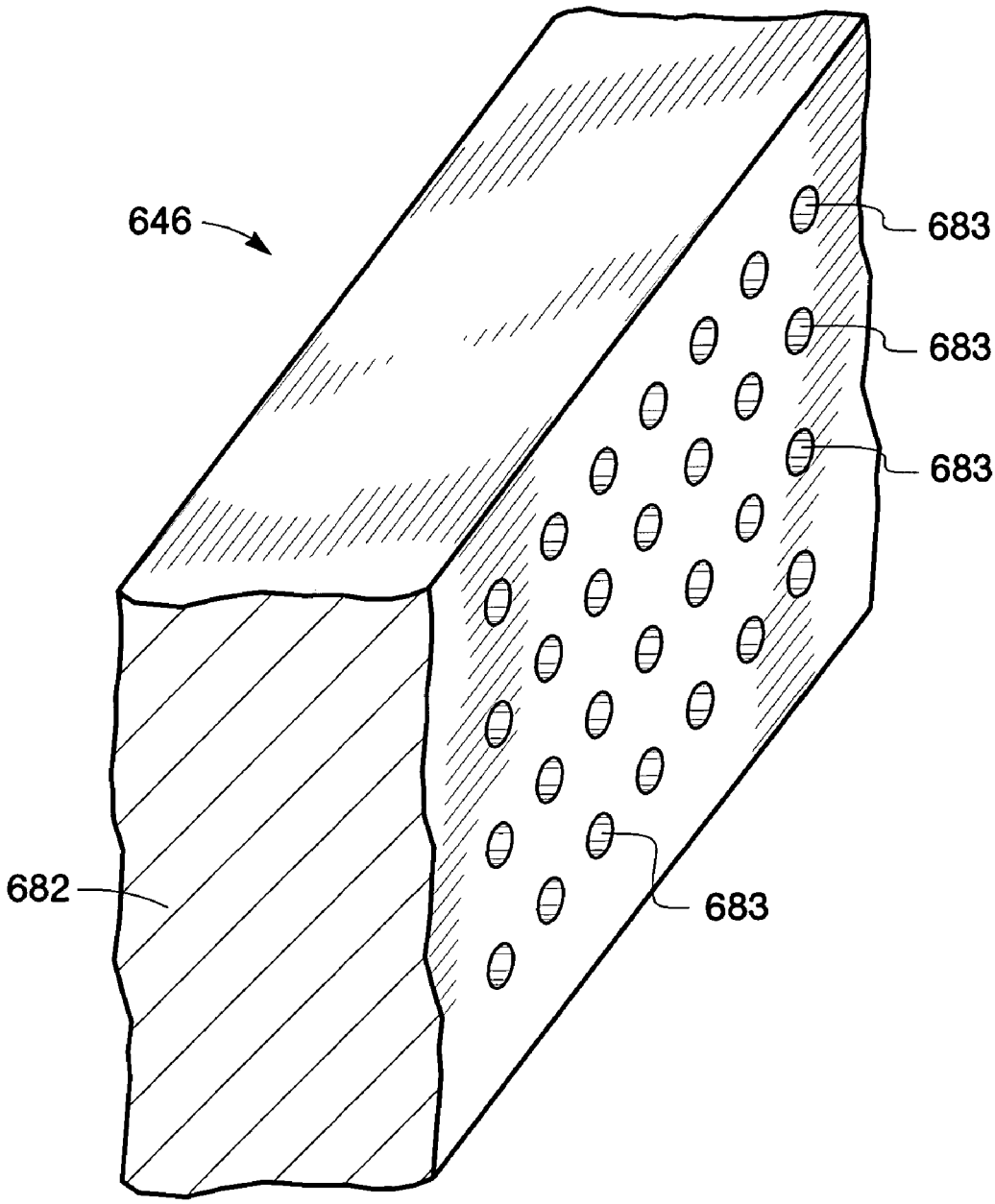
FIG. 6 is an isometric view of a photon collimator according to an embodiment of the present invention.

An example of an alternative structure that may be utilized for a photon focusing array is shown in an isometric view in FIG. 6. In this example, photon collimator 646 includes body 682 formed from a material having an index of refraction $n_1$ optical waveguide 683 formed from a material having an index of refraction $n_2$ where $n_2$ is greater than $n_1$. The photon beam is transmitted along the length of waveguide 683 by internal reflection at the step change in the refractive index maintaining the emitted photon beam from photon source 640 essentially in the central core or optical waveguide 683 with minimal loss at the surface of waveguide 683. In alternate embodiments, graded-index structures also may be utilized depending on the particular photon source utilized for the fluid dispensing system. For example, a photon source having a particular multi-mode emission pattern may utilize a graded-index having a parabolic grading of $n_2$.

Figure 7A:
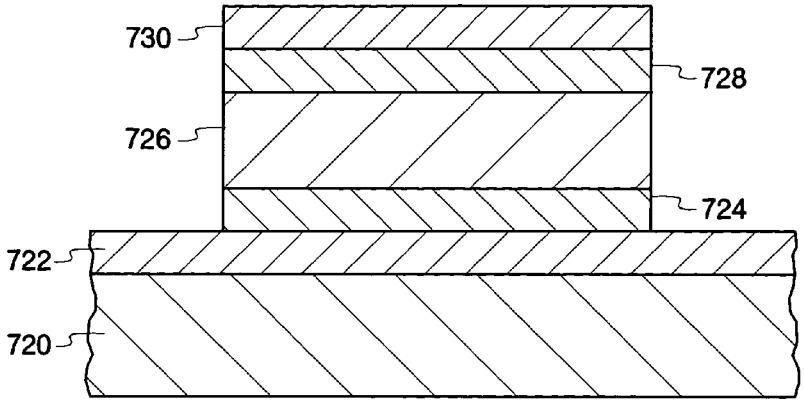
FIG. 7*a* is a simplified cross-sectional view of an individual element of an electroluminescent array according to an embodiment of the present invention.

An individual element of photon source array 547 (see FIG. 5*b*) as well as a photon source for other embodiments of the present invention is shown in a simplified cross-sectional view in FIG. 7*a*. In this embodiment, photon source array 747 is an electroluminescent array formed on photon source substrate 720 utilizing electroluminescent layer 726 as the layer in which photons are generated. Photon source array 747 includes any of the electroluminescent sources such as devices emitting light by electrofluorescence or electrophosphorescence or combinations and mixtures of both. Photon source array 747 may be driven by either an ac or dc electrical source depending on the particular material or materials used to form electroluminescent layer 726. First electrode layer 722 is deposited or formed on photon source substrate 720. In this embodiment, light is emitted through first electrode layer 722 and substrate 720. Substrate 720 is any material, which is substantially optically transparent in the wavelength region over which electroluminescent layer 726 emits. For example, if electroluminescent layer 726 emits in the visible region of the electromagnetic spectrum, substrate 720 may be formed from any of the various glasses such as borosilicate, soda lime or quartz glasses (including crystalline and amorphous), or various polymers such as polycarbonates, polyesters such as polyethylene terephthalate, polystyrene, and polyacrylates such as polymethylacrylate. First electrode layer 722 may be any electrically conductive material, which is also substantially optically transparent in the wavelength region over which electroluminescent layer 726 emits. For example antimony tin oxide or indium tin oxide deposited or formed on substrate 720 may be utilized. In alternate embodiments, light may be emitted through second electrode layer 730 in which case second electrode would be formed from an appropriate optically transparent material. First dielectric layer 724 is formed on first electrode layer 722, and may be formed from any high dielectric strength material having the appropriate optical transparency for the electroluminescent material being utilized. For example, first dielectric layer 724 may be formed from silicon dioxide, aluminum oxide, polycarbonate, or polyester. Electroluminescent layer 726 is formed over first dielectric layer 724 and second dielectric layer 728 is formed over electroluminescent layer 726 followed by formation of second electrode layer 730 formed over second dielectric layer 728. In an alternate embodiment, electroluminescent layer 726 may be formed directly on first electrode layer 722 eliminating first dielectric layer 724. Second dielectric layer 728 may be formed from any of the high dielectric strength materials utilized in various electronic applications. Second electrode layer may be formed from any of the metal or organic electrical conductors utilized in various electronic applications. For example, dielectric materials include silicon dioxide, silicon nitride, silicon carbide, aluminum oxide, boron nitride, barium titanate, as well as layers formed from combinations of such materials. Electrical conductors include metals, and doped semiconductor materials. A few examples are aluminum, silver, tungsten, gold, cesium, as well as carbon and doped polysilicon or germanium. In addition, organic conductors also may be utilized such as polyaniline compounds including camphorsulfonic acid doped polyaniline, polypyrroles, pentacenes, anthracenes, napthacenes, phenanthrenes, pyrenes, thiophene compounds, conductive ink, and similar materials.

Figure 7B:
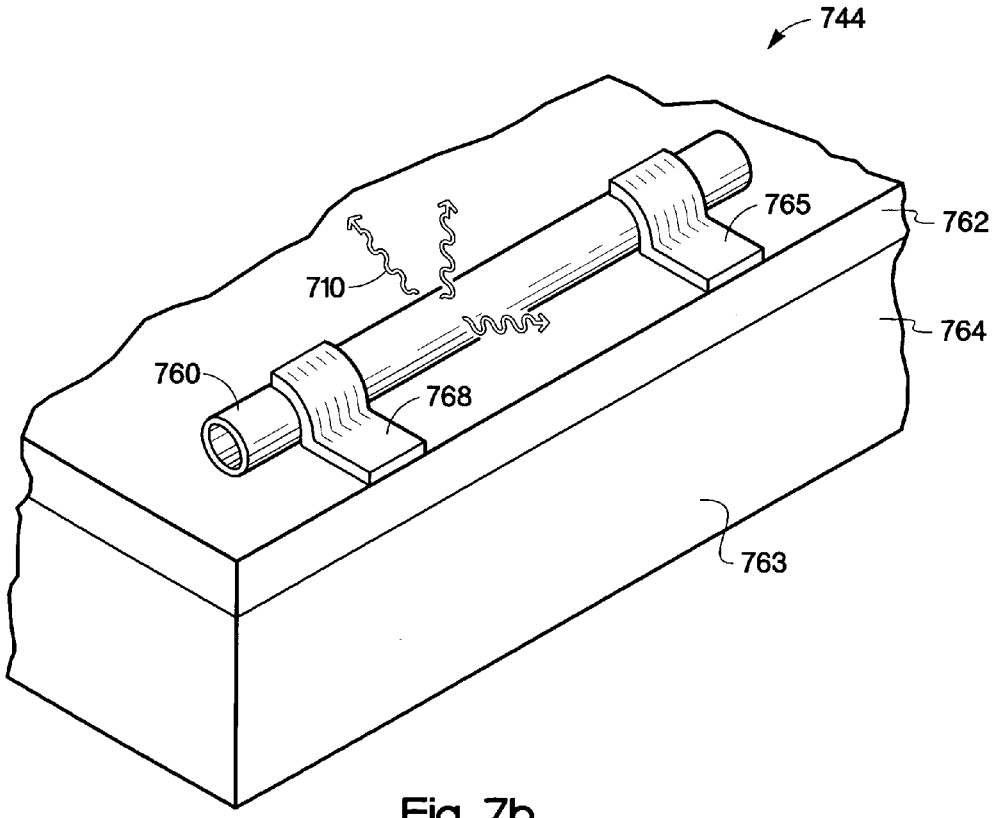
FIG. 7*b* is an isometric cross-sectional view of an individual carbon nanotube photon emitter of a photon source according to an embodiment of the present invention.

Electroluminescent layer 726 may be formed utilizing any of the wide variety of inorganic phosphors, organic materials including polymeric materials, and hybrid layers containing inorganic/organic dispersions. Examples of inorganic phosphors that may be utilized include zinc sulfide, zinc selenide, zinc telluride, manganese sulfide, cadmium telluride, cadmium sulfide, cadmium selenide. Examples of organic materials that may be utilized include aluminum quinolate, 10-azoanthracene (i.e. acridine), 3,6 acridinediamine, carbazole and substituted carbazoles;

Referring to FIG. 7*b*, an alternate embodiment of a photon source is shown in a simplified cross-sectional isometric view. In this embodiment, the photon source includes multiple carbon nanotube photon emitters combined to form a photon source. In alternate embodiments multiple groups of carbon nanotube photon emitters are combined to form an array of photon sources. In FIG. 7*b* one carbon nanotube photon emitter 744, of the multiple emitters contained in the photon source, includes carbon nanotube 760 operated as a three terminal field effect transistor. Carbon nanotube 760 is in contact with silicon dioxide layer 762 formed on p+ silicon substrate 764. Source contact 765 and drain contact 768 are formed over portions of carbon nanotube 760. Carbon nanotube 760 is formed by laser ablation and deposited on silicon dioxide layer 762 via a solution of the carbon nanotubes in, for example, dichloroethane. Source contact 765 and drain contact 768 are formed from titanium deposited onto portions of carbon nanotube 760 utilizing lithography and lift-off techniques. Source contact 765 and drain contact 768 are about 50 nanometers in thickness. In alternate embodiments, other metals capable of forming metal-nanotube Schottky barriers may also be utilized as well as thicknesses in the range from 10 nanometers to about 100 nanometers. Silicon dioxide layer 762 in this embodiment is about 150 nanometers in thickness; however, in alternate embodiments thicknesses in the range from about 10 nanometers to about 200 nanometers also may be utilized. In this embodiment, a silicon dioxide layer (not shown) is also deposited over carbon nanotube 760, as well as source 765 and drain 768 contacts. In alternate embodiments other dielectric materials having the appropriate optical characteristics may also be utilized. In addition, in alternative embodiments, substrate 764 may be formed from any semiconductor material either n+ or p+ such as silicon or gallium arsenide. Substrate 764 forms gate contact 763. The band gap in carbon nanotubes is inversely proportional to the tube diameter. Carbon nanotube 760, in this embodiment has a diameter of about 1.4 nanometers, providing photons 710 in the infrared region of the spectrum. In alternate embodiments, by varying the diameter of the carbon nanotube the wavelength output of carbon nanotube emitter 764 may be controlled.

Figure 8:
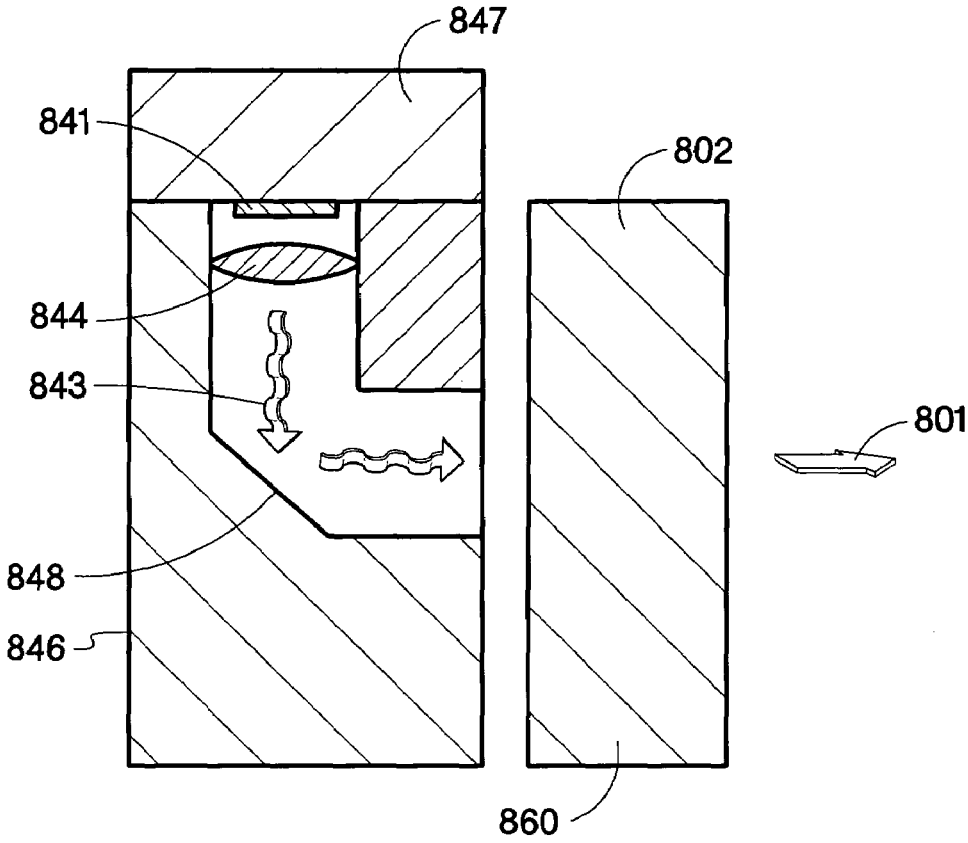
FIG. 8 is a simplified cross-sectional view of a fluid ejector array having the photon source mounted off-axis to the fluid ejection axis according to an embodiment of the present invention.

Referring to FIG. 8, a simplified cross-sectional view of an alternate embodiment of fluid ejector array 802 of the present invention is shown. In this embodiment, photon source array 847 is mounted to fluid ejector array substrate 860 so that the photon beam 843 is off axis to fluid ejection axis 801. In this embodiment, photon beam 843 is essentially ninety degrees from fluid ejection axis 801; however in alternate embodiments, photon beam 843 may be any angle from about zero degrees to about 180 degrees. Light from photon emitter 841 is focused into photon beam 843 by lens 844 of photon focusing array 846. Photon beam is in turn reflected off of surface mirror 848, also part of photon focusing array 846, onto fluid ejector array substrate 860. In alternate embodiments, other optical devices that change or deviate the direction of the photon beam may also be utilized such as a prism. Fluid ejector array substrate 860 includes a photodetector (not shown) electrically coupled to a fluid ejector (not shown).

Figure 9:
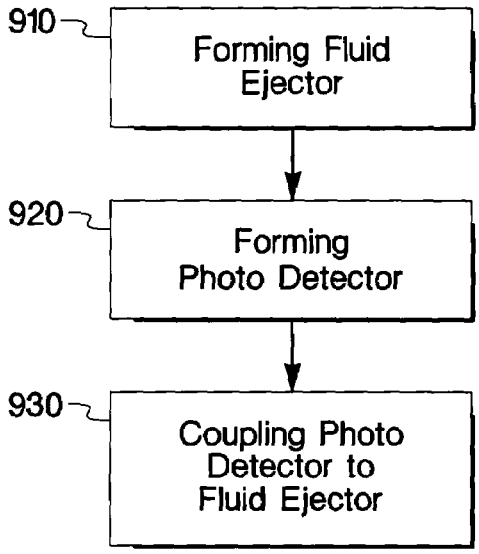
FIG. 9 is a flow diagram of a method of manufacturing a fluid dispensing system according to an embodiment of the present invention.

A flow diagram of a method of manufacturing a fluid dispensing system, according to an embodiment of the present invention, is shown in FIG. 9. Fluid ejector forming process 910 is utilized to form the fluid ejector on a substrate, and depends on the particular transducer being utilized in the fluid dispensing system to create the fluid ejector. The substrate may be formed from a wide range of materials including semiconductor wafers such as silicon gallium arsenide, indium phosphide, germanium; various glasses, ceramics such as aluminum oxide, boron nitride, silicon carbide, sapphire; and various polymers such as polyimides, polyesters, polyacrylates polystyrenes and polycarbonates. A glass substrate may include any of the borosilicate, soda lime or quartz glasses (including crystalline and amorphous). In addition, materials such as silicon oxide including silicon dioxide or silicon oxynitride, silica mixed with oxides of, for example, potassium, calcium, barium or lead. For those embodiments utilizing a photodetector formed on the same major surface as the fluid energy converting element the generally the substrate will have sufficient transmittance in the wavelength region of photons emitted from the photon source to provide a signal to noise ratio of at least two to one at the detector. However, in alternate embodiments, the substrate may be opaque to the photons, and either the photodetector is disposed on the same side of the substrate as the photon source is scanned over or windows or channels are formed in the substrate providing an optical path for the photons emitted from the photon source to impinge upon the photodetectors. For example, channels may be etched or formed in an opaque substrate to form optical paths to the photodetectors.

The present invention is not intended to be limited to those devices fabricated in silicon semiconductor materials, but will include those devices fabricated in one or more of the available semiconductor materials and technologies known in the art, such as thin-film-transistor (TFT) technology using polysilicon on glass substrates. Further, the substrate is not restricted to typical wafer sizes, and may include processing a polymer sheet or film or glass sheet or for example a single crystal sheet or a substrate handled in a different form and size than that of conventional wafers or substrates. The actual substrate material utilized will depend on various system components such as the particular fluid ejector utilized, the particular fluid being ejected, the size and number of fluid ejectors utilized in the particular fluid dispensing system, and the environment to which the fluid dispensing system will be subjected.

In those embodiments utilizing a fluid ejector that includes a fluid energy converting element, the energy converting element is generally formed on the substrate utilizing conventional semiconductor processing equipment involving various lithography and etching processes. In alternative embodiments, micromolding, electrodeposition, electroless deposition may also be utilized. For example, in those embodiments utilizing thermal resistor elements, a resistor is formed as a tantalum aluminum alloy utilizing conventional semiconductor processing equipment, such as sputter deposition systems for forming the resistor and etching and photolithography systems for defining the location and shape of the resistor layer. In alternate embodiments, resistor alloys such as tungsten silicon nitride, or polysilicon may also be utilized. In other alternative embodiments, fluid drop generators other than thermal resistors, such as piezoelectric transducers, or ultrasonic transducers may also be utilized. For example, in those embodiments utilizing a piezoelectric element a flexible membrane or wall is formed on the substrate and a piezoceramic element, is formed or attached to the non-fluid side of the membrane. In still other embodiments, such as those utilizing compressed air the fluid ejector may be created with a valve in fluid communication with a fluid chamber.

Photodetector forming process 920 utilizes conventional thin film processing equipment to form a photodetector. The photodetector may be formed on the substrate utilized to form the fluid ejector or fluid energy converting element. For example, the photodetector may be a photodiode formed by creating doped wells in the substrate of opposite polarity to the dopant of the substrate (e.g. p-type wafer with n-type wells or n-type wafer with p-type wells) if a semiconductor substrate is utilized. Electrical interconnects are formed to connect with both the substrate and the doped well. Another example, is the deposition of polysilicon or epitaxial silicon on a buried oxide with corresponding doped well regions formed in the deposited layer to generate a photodiode. By utilizing various combinations of doped wells and layers, various photodiodes such as p-i-n photodiodes or photodiodes optimized to operate in the avalanche region as well as phototransistors are just a few examples of structures that may be utilized to form the photodetector. The particular photodetector utilized will depend on various parameters such as the wavelength and intensity of the photon source utilized, presence or absence of amplifying devices, firing speed of the fluid ejector, as well as the particular environment in which the fluid dispensing system will be utilized.

Coupling process 930 is utilized to electrically couple the photodetector to the fluid ejector or fluid energy converting element depending on the particular embodiment being utilized. For example, for those embodiments utilizing a substrate that is sufficiently optically transparent to the wavelength region emitted from the photon source the photodetector may be formed on the same major surface of the substrate as the fluid ejector. In such embodiments conventional semiconducting equipment is generally utilized to form electrical conductors coupling the photodetector to the fluid ejector. The electrical conductors may be formed from any of the metals such as aluminum including aluminum-copper-silicon alloys, tungsten, copper, gold, palladium, or heavily doped polysilicon. For those embodiments where the substrate does not have sufficient transmittance in the wavelength region emitted from the photon source to provide a useable signal to noise ratio, the photodetector may be formed on the opposing major surface to that utilized to form the fluid ejector. In this case through holes or through vias may be formed in the substrate utilizing dry or wet etching techniques or combinations of both. For example to form the through vias in a silicon substrate a dry etch may be used when vertical or orthogonal sidewalls are desired. However, when sloping sidewalls are desired a wet etch such as tetra methyl ammonium hydroxide (TMAH) may be utilized. In addition, combinations of wet and dry etch may also be utilized when more complex structures are utilized to form the vias. Other processes such as laser ablation, reactive ion etching, ion milling including focused ion beam patterning, may also be utilized to form the through holes depending on the particular substrate material utilized. Micromolding, electroforming, punching, or chemical milling are also examples of techniques that may be utilized depending on the particular substrate material utilized. Sputter deposition, thermal evaporation, electrodeposition, electroless deposition are a few examples of processes that may be utilized to fill the through hole with an electrical conductor. Electrical traces from the through hole or via to the photodetector and fluid ejector may then be formed utilizing processes described above. In addition, for those embodiments utilizing an amplifier or control circuitry, such as that shown in FIGS. 1*d* and 1*c*, an active device forming process may be utilized to form various transistors, logic circuits and other passive devices electrically coupled to the photodetector and/or the fluid ejector. The active device forming process may utilize conventional semiconductor processing or flat panel thin film equipment, or combinations of both to form transistors, as well as the other logic devices required for the operation of the fluid dispensing system, on the substrate. These transistors and other logic devices typically are formed as a stack of thin film layers on the substrate. The particular structure of the transistors will depend on the particular application in which the fluid ejector is utilized; however, various types of solid-state electronic devices may be utilized, such as, metal oxide field effect transistors (MOSFET), or bipolar junction transistors (BJT). As described earlier, various substrate materials may be utilized. Accordingly, technologies such as thin-film-transistor (TFT) technology using polysilicon or amorphous silicon as well as well as active devices formed utilizing organic semiconducting materials may, also, be utilized.

Depending on the particular embodiment utilized as well as the particular application in which the fluid dispensing system may be utilized, the following processes may, also, be used. A chamber layer forming process may be utilized to form the fluid chamber around the fluid ejector. The particular process depends on the particular material chosen to form the chamber layer, or the chamber orifice layer when an integrated chamber layer and nozzle layer is used. The particular material chosen will depend on parameters such as the fluid being ejected, the expected lifetime of the fluid dispensing system, the dimensions of the fluid ejection chamber and fluidic feed channels among others. Generally, conventional photoresist and photolithography processing equipment or conventional circuit board processing equipment is utilized. For example, the processes used to form a photoimagible polyimide chamber layer would be spin coating and soft baking. However, forming a chamber layer, from what is generally referred to as a solder mask, would typically utilize either a coating process or a lamination process to adhere the material to the substrate. Other materials such as silicon oxide or silicon nitride may also be formed into a chamber layer, using deposition tools such as plasma enhanced chemical vapor deposition or sputtering.

A side wall definition process may be utilized to form the sidewalls and define the geometrical structure of the fluid ejection chamber. The side wall definition process typically utilizes photolithography tools for patterning. For example, after either a photoimagible polyimide or solder mask has been formed on the substrate, the chamber layer would be exposed through a mask having the desired chamber features. The chamber layer is then taken through a develop process and typically a subsequent final bake process after develop. Other embodiments may also utilize a technique similar to what is commonly referred to as a lost wax process. In this process, typically a lost wax or sacrificial material that can be removed, through, for example, solubility, etching, heat, photochemical reaction, or other appropriate means, is used to form the fluidic chamber and fluidic channel structures as well as the orifice or bore. Typically, a polymeric material is coated over these structures formed by the lost wax material. The lost wax material is removed by one or a combination of the above-mentioned processes leaving a fluidic chamber, fluidic channel and orifice formed in the coated material.

A nozzle or orifice forming process is utilized to form a nozzle layer and form the nozzles or bores in the nozzle layer. The nozzle forming process depends on the particular material chosen to form the nozzle layer. The particular material chosen will depend on parameters such as the fluid being ejected, the expected lifetime of the fluid dispensing system, the dimensions of the bore, bore shape and bore wall structure among others. Generally, laser ablation may be utilized; however, other techniques such as punching, chemical milling, or micromolding may also be used. The method used to attach the nozzle layer to the chamber layer also depends on the particular materials chosen for the nozzle layer and chamber layer. Generally, the nozzle layer is attached or affixed to the chamber layer using either an adhesive layer sandwiched between the chamber layer and nozzle layer, or by laminating the nozzle layer to the chamber layer with or without an adhesive layer.

As described above, some embodiments may utilize an integrated chamber and nozzle layer structure referred to as a chamber orifice or chamber nozzle layer. This layer will generally use some combination of the processes already described depending on the particular material chosen for the integrated layer. For example, in one embodiment a film typically used for the nozzle layer may have both the nozzles and fluid ejection chamber formed within the layer by such techniques as laser ablation or chemical milling. Such a layer can then be secured to the substrate using an adhesive. In an alternate embodiment a photoimagible epoxy can be disposed on the substrate and, then using conventional photolithographic techniques, the chamber layer and nozzles may be formed, for example, by multiple exposures before the developing cycle. In still another embodiment, as described above, the lost wax process may also be utilized to form an integrated chamber layer and nozzle layer structure.

A fluid inlet channel forming process may be utilized to form fluid inlet channels and fluid distribution channels in the substrate. The fluid inlet channel forming process depends on the particular material utilized for the substrate. For example, to form the fluid inlet channels in a silicon substrate, a dry etch may be used when vertical or orthogonal sidewalls are desired. However, when sloping sidewalls are desired a wet etch such as tetra methyl ammonium hydroxide (TMAH) may be utilized. In addition, combinations of wet and dry etch may also be utilized when more complex structures are utilized to form the fluid inlet channels. Other processes such as laser ablation, reactive ion etching, ion milling including focused ion beam patterning, may also be utilized to form the fluid inlet channels depending on the particular substrate material utilized. Micromolding, electroforming, punching, or chemical milling are also examples of techniques that may be utilized depending on the particular substrate material utilized.

Figure 10:
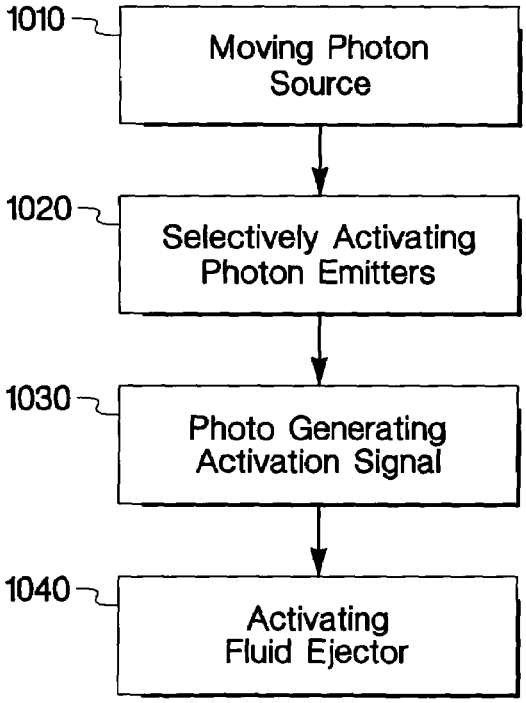
FIG. 10 is a flow diagram of a method of using a fluid dispensing system according to an embodiment of the present invention.

Referring to FIG. 10, a flow diagram of a method of using a fluid dispensing system, according to an embodiment of the present invention, is shown. Moving photon source process 1010 is utilized to move the carriage or photon source holder over at least a portion of the back of or non fluid ejecting side of the fluid ejector array. In one embodiment, the carriage may be scanned over or linearly translated across the entire length of the fluid ejector array, for example, when the photon source includes a single photon emitter. In an alternate embodiment the carriage may be translationally reciprocated over at at least a portion of the fluid ejector array. In still other embodiments other scanning distances as well as scanning patterns also may be utilized. In addition, for those embodiments utilizing multiple rows of fluid ejectors the carriage may be scanned or translated over the fluid ejector utilizing various two dimensional patterns, such as sinusoidally, triangular, or square wave patterns.

Selective photon activation process 1020 is utilized to selectively activate a photon emitter, of the photon source array, to emit photons. Under control of the drop firing controller and the position controller, the photon source disposed on the carriage scans across or over at least a portion of the fluid ejector array selectively emitting photons from a particular photon emitter when that emitter is photonically coupled to a desired photodetector. Photon activation process 1020 generally depends on the particular photosite being activated; however, generally both amplitude modulation and pulse width modulation may be utilized to control the intensity of photons emitted and time over which photons are emitted. Depending on the particular system utilized (i.e. photon source, photodetector, and the fluid ejector), the photon activation process may utilize various pulse schemes from simple square wave pulses to more complex wave patterns, depending on, for example, the particular pressure response function of the fluid ejector.

Photo-generating activation signal process 1030 is utilized to generate a signal to actuate the fluid ejector. Photons emitted from the photon source and absorbed by the photodetector are converted into an electrical signal thereby generating an activation signal. For those embodiments utilizing a photodiode, the photons absorbed in the active region of the photodiode increase the electrical conductivity of the photodiode generating the activation signal. For those embodiments utilizing a phototransistor coupled to control circuitry, photons absorbed in the base region of the phototransistor increase the electrical conductivity and generate a current that may be coupled to a memory device as shown in FIG. 1*c* or to other transistors, amplifiers or logic devices for further amplification and/or modification.

Fluid ejector activating process 1040 is utilized to activate the fluid ejector. The fluid ejector disposed on or within the fluid ejector array and electrically coupled to the activated photodetector provides an energy impulse to the fluid selectively ejecting fluid drops from that particular fluid onto the fluid receiving medium. Fluid ejector activating process depends on the particular fluid ejector utilized. For example, those embodiments utilizing a photodiode coupled to a thermal resistor the increase in electrical conductivity of the photodiode provides a drive current from a power supply causing an energy impulse to be distributed throughout the thermal resistor rapidly heating a component in the fluid above its boiling point to cause vaporization of the fluid component resulting in an expanding bubble that ejects fluid from the fluid ejector. Another example is those embodiments utilizing a piezoelectric transducer, the photo-generated activation signal applies a voltage pulse across the piezoelectric element to generate a compressive force on the fluid, resulting in ejection of a drop of the fluid.

What is claimed is:

1. A fluid dispensing system, comprising:

a photon source disposed on a moveable carriage; and a fluid ejector array having a plurality of fluid ejection elements disposed on a substrate, each fluid ejection element having:

a fluid ejector, and a photodetector electrically coupled to said fluid ejector, wherein moving said photon source over at least a portion of said fluid ejector array, selectively illuminates photodetectors, thereby selectively activating fluid ejectors coupled to illuminated photodetectors.

2. The fluid dispensing system in accordance with claim 1, further comprising a drop firing controller coupled to said photon source and to said fluid ejector array.

3. The fluid dispensing system in accordance with claim 2, further comprising:

a memory device coupled to said drop firing controller; and a position controller coupled to said memory device.

4. The fluid dispensing system in accordance with claim 3, further comprising:

a medium advancing motor advancing a fluid receiving medium; and a carriage motor moving said photon source, said medium advancing motor and said carriage motor coupled to said position controller, wherein said fluid ejector array dispenses a fluid on at least a portion of said fluid receiving medium.

5. The fluid dispensing system in accordance with claim 4, wherein said position controller and said drop-firing controller dispense said fluid in a two dimensional array on said fluid receiving medium.

6. The fluid dispensing system in accordance with claim 1, wherein said moveable carriage further comprises a reciprocating carriage.

7. The fluid dispensing system in accordance with claim 6, wherein said reciprocating carriage further comprises a linearly translated reciprocating carriage.

8. The fluid dispensing system in accordance with claim 1, wherein said moveable carriage further comprises a translationally moveable carriage.

9. The fluid dispensing system in accordance with claim 1, wherein said moveable carriage further comprises a two dimensionally moveable carriage.

10. The fluid dispensing system in accordance with claim 1, wherein said photon source emits photons in a predetermined wavelength region and said substrate has sufficient transmittance in said wavelength region providing a signal to noise ratio of at least two to one.

11. A fluid dispensing system, comprising:

means for emitting photons disposed on a reciprocating carriage;

a fluid ejector array having:

a plurality of means for generating an energy impulse to a fluid, disposed on a substrate, and a plurality of means for detecting photons electrically coupled to said means for generating an energy impulse, wherein translationally scanning said carriage across said fluid ejector array said means for emitting photons photonically couplable to each of said means for detecting photons, wherein photons emitted from said means for emitting photons selectively interacts with said plurality of means for detecting photons generating activation signals, thereby selectively activating said means for generating an energy impulse ejecting a fluid away from said fluid ejector array.

12. A fluid dispensing system, comprising:

means for emitting photons disposed on a moveable carriage; and a fluid ejector array having a plurality of fluid ejection elements disposed on a substrate, each fluid ejection element having:

means for generating an energy impulse to a fluid, disposed on said substrate means for detecting photons electrically coupled to said means for generating an energy impulse, wherein moving said carriage over said fluid ejector array said means for emitting photons selectively illuminating said means for detecting photons, thereby selectively activating said means for generating an energy impulse coupled to said illuminated means for detecting photons ejecting said fluid away from said fluid ejector array.

13. The fluid dispensing system in accordance with claim 12, further comprising means for selectively activating said plurality of fluid ejection elements, said means for selectively activating coupled to said means for emitting photons and to said means for detecting photons.

14. The fluid dispensing system in accordance with claim 12, wherein said moveable carriage further comprises means for reciprocating said moveable carriage.

15. The fluid dispensing system in accordance with claim 12, wherein said moveable carriage further comprises means for translating said moveable carriage.

16. The fluid dispensing system in accordance with claim 12, wherein said moveable carriage further comprises means for in two dimensionally translating said moveable carriage.

17. A fluid dispensing system, comprising:

an array of fluid ejectors disposed on an substrate;

a photodetector electrically coupled to each fluid ejector of said array of fluid ejectors;

a moveable carriage having at least one photon source disposed on or in said carriage; and a fluid ejector controller electrically coupled to said at least one photon source, wherein moving said at least one photon source across said array of fluid ejectors selectively couples at least one photon source to a predetermined number of said photodetectors, wherein photons emitted from said at least one photon source interact with said predetermined number of said photodetectors generating activation signals activating a predetermined number of fluid ejectors to eject a fluid away from said fluid ejectors.

18. A fluid dispensing system, comprising:

a photon source disposed on or within a moveable carriage;

a fluid ejector array having a plurality of fluid ejection elements disposed on a substrate, each fluid ejection element having:

a fluid ejector, a photodetector, a memory device coupled to said photodetector, and a voltage level shifter electrically coupled to said memory device and to said fluid ejector, a focusing element disposed between said photon source and said photodetector;

a drop firing controller coupled to said photon source and to said fluid ejector array, wherein moving said photon source over at least a portion of said fluid ejector array, said drop firing controller selectively illuminates photodetectors, thereby selectively activating fluid ejectors coupled to said illuminated photodetectors.

19. A method of manufacturing a fluid dispensing system, comprising:

mounting a photon source on a moveable carriage;

creating a fluid ejector array having a plurality of fluid ejection elements disposed on a substrate, each element including:

a fluid ejector, a photodetector, a memory device coupled to said photodetector, and a voltage level shifter coupled to said memory device and to said fluid ejector, creating a focusing element disposed between said photon source and photodetectors;

creating a drop firing controller coupled to said photon source and to said fluid ejector array, wherein moving said photon source over said fluid ejector array, said drop firing controller selectively illuminates said photodetectors, thereby selectively activating fluid ejectors coupled to illuminated photodetectors.

20. A method of using a dispensing system, comprising:

moving a photon source mounted in a moveable carriage over at least a portion of an array of photodetectors;

selectively activating said photon source to emit photons while moving over said array of photodetectors focusing said emitted photons on predetermined photodetectors of said array of photodetectors;

photo-generating fluid ejector activation signals in said predetermined photodetectors;

amplifying said fluid ejector activation signals;

coupling said amplified activation signals to an array of fluid ejectors; and activating said fluid ejectors to eject a fluid.

* * * * *